US008780156B2

(12) United States Patent
Furuki et al.

(10) Patent No.: US 8,780,156 B2
(45) Date of Patent: Jul. 15, 2014

(54) PRINT CONTROL DEVICE

(75) Inventors: Ichirou Furuki, Tokyo (JP); Yoshifumi Yamamoto, Tokyo (JP); Takashi Hatakenaka, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 13/979,765

(22) PCT Filed: Nov. 2, 2011

(86) PCT No.: PCT/JP2011/006142
§ 371 (c)(1),
(2), (4) Date: Jul. 15, 2013

(87) PCT Pub. No.: WO2012/095912
PCT Pub. Date: Jul. 19, 2012

(65) Prior Publication Data

US 2013/0286139 A1 Oct. 31, 2013

(30) Foreign Application Priority Data

Jan. 14, 2011 (JP) ..... 2011/000175

(51) Int. Cl.
*B41J 17/28* (2006.01)
*B41J 2/32* (2006.01)

(52) U.S. Cl.
USPC ..... 347/217; 347/171

(58) Field of Classification Search
USPC ..... 347/171, 188, 189, 190, 214, 215, 217
See application file for complete search history.

(56) References Cited

U.S. PATENT DOCUMENTS 5,555,012 A * 9/1996 Ellson et al. ..... 347/217
5,664,893 A * 9/1997 Meeussen et al. ..... 347/189
5,691,961 A * 11/1997 Paranjpe ..... 347/217
5,741,079 A 4/1998 Hayama et al.
5,982,405 A * 11/1999 Sasaki et al. ..... 347/171

(Continued)

FOREIGN PATENT DOCUMENTS

JP 62 82061 4/1987
JP 10 309817 11/1998

(Continued)

OTHER PUBLICATIONS

International Search Report Issued Dec. 6, 2011 in PCT/JP11/006142 Filed Nov. 2, 2011.

*Primary Examiner* — Kristal Feggins
(74) *Attorney, Agent, or Firm* — Oblon, Spivak, McClelland, Maier & Neustadt, L.L.P.

(57) ABSTRACT

An ink sheet damage calculating unit compares image element density data of each of areas into which an image is divided by an image area dividing unit with a first threshold to calculate the total number of pixels each having density data equal to or larger than the first threshold for each area, and then compares the total number of pixels calculated for each area with a second threshold. A printing operation selecting unit uses a remaining area of an already-used ink area for formation of a next print image when the total number of pixels is smaller than the second threshold in every one of all the areas, and uses an ink area in a new unit area for formation of a next print image when the total number of pixels is equal to or larger than the second threshold.

10 Claims, 22 Drawing Sheets

(56) References Cited

U.S. PATENT DOCUMENTS

| | | | | |
|---|---|---|---|---|
| 6,437,814 | B1 | 8/2002 | Shimonaga et al. | |
| 7,397,489 | B2 | 7/2008 | Mindler et al. | |
| 7,746,367 | B2 * | 6/2010 | Yamazaki | 347/188 |
| 2009/0009579 | A1 | 1/2009 | Yamazaki | |

FOREIGN PATENT DOCUMENTS

| | | |
|---|---|---|
| JP | 11 227240 | 8/1999 |
| JP | 3294117 | 4/2002 |
| JP | 2004 202941 | 7/2004 |
| JP | 3626404 | 12/2004 |
| JP | 2006 068952 | 3/2006 |
| JP | 2007 90798 | 4/2007 |
| JP | 2007 196575 | 8/2007 |
| JP | 2009 234085 | 10/2009 |
| JP | 4457452 | 2/2010 |
| JP | 2010 240949 | 10/2010 |
| WO | 2007 099940 | 9/2007 |

* cited by examiner

PRINT CONTROL DEVICE

FIELD OF THE INVENTION

The present invention relates to a print control device for use in a sublimation type thermal transfer printer that uses a large-size ink sheet (ink film) to print a plurality of small-size images.

BACKGROUND OF THE INVENTION

Some sublimated type color thermal transfer printers use an ink sheet coated with a yellow (Y) ink area, a magenta (M) ink area, and a cyan (C) ink area extending sequentially in a longitudinal direction, and also uses a rolled paper as a recording paper. In such a thermal transfer printer, heat is applied from a thermal head to the ink sheet and an image of each color is printed overlappedly in the same area of the recording paper to form a color image.

In this case, when the image area formed has an upper limit which is the ink areas and an image smaller than the ink areas is printed, for example, when a single L size (3R size) image is printed by using an ink sheet for 2L size (5R size), a problem is that because only a half of each of the Y, M, and C color ink areas is used and therefore each remaining ink area is not used, the ink use efficiency is bad.

To solve this problem, as a printing method which improves the ink use efficiency, a method of rewinding an ink sheet after producing a print of an L size image by using a front half ink area on an ink sheet take-up side of each of Y, M, and C color ink areas of the ink sheet, and printing the next L size image by using a rear half ink area on an ink sheet supply side which is a yet-to-be-used area in each of the ink areas which have been used for the previous print, thereby producing a print of two screens from the single set of Y, M, and C ink areas is known.

In this case, the ink sheet is rewound temporarily after the thermal head is detached from the ink sheet, and the thermal head is brought into contact with the ink sheet again. At this time, a problem is that because the ink sheet which has been used for a print of the 1st of the two screens is placed immediately before the print start point of the 2nd of the two screens, and the used ink sheet receives damage due to the heat energy applied thereto from the thermal head, an appropriate ink sheet tension cannot be applied to the print start point of the 2nd of the two screens, and hence wrinkles can easily occur in the ink sheet. To solve this problem, a conventional method of printing the 1st of two screens by using an ink sheet supply side of the ink sheet and then printing the 2nd of the two screens from an ink sheet take-up side of the ink sheet, thereby preventing wrinkles from occurring in the print start point of the 2nd of the two screens, has been provided (for example, refer to patent reference 1).

Further, another conventional method of predicting the degree of damage which an ink sheet will receive after printing the 1st of two screens on the basis of the density of a whole image which is the target for the print of the 1st of the two screens, and the average grayscale of the whole image, and determining whether ink areas on an ink sheet take-up side or on an ink sheet supply side of the ink sheet are used for the print of the 1st of the two screens has been provided (for example, refer to patent reference 2).

RELATED ART DOCUMENT

Patent Reference

Patent reference 1: Japanese Unexamined Patent Application Publication No. 2004-202941

Patent reference 2: Japanese Unexamined Patent Application Publication No. 2007-090798

SUMMARY OF THE INVENTION

Problems to be Solved by the Invention

However, the technology described in the above-mentioned patent reference 1 raises the possibility that, when the degree of damage which the ink sheet will receive is large, wrinkles occur in the ink sheet or the ink sheet is broken at the time of rewinding the ink sheet. Further, a problem with the method described in the patent reference 2 is that although ink areas used for a print of the 1st of two screens is determined on the basis of the density of a whole image which is the target for the print and the average grayscale of the whole image, the determination method of simply determining ink areas used for a print of the 1st of two screens on the basis of the density of the whole image and the average grayscale of the whole image provides a bad degree of determination precision because the ink sheet screen area actually has an area in which the ink sheet easily receives damage or an area in which wrinkles easily occur.

FIG. 18 is a diagram for explaining an area in which the ink sheet easily receives damage or an area in which wrinkles easily occurs in an ink sheet area, for example. An ink screen area 101 represents an area of either one of Y, M, and C color inks, and has a 1st-of-2-screens print area 102*a* and a 2nd-of-2-screens print area 102*b*. Generally, in a printer which complies with frameless prints, an ink screen area is set to have a larger size than an image print area. Therefore, an ink margin S occurs both at right and left ends of the print area.

A part of the ink sheet in an area from which an image is transferred to a recording paper and from which the ink is transferred receives damage, and the rigidity of the part of the ink sheet varies before and behind the printing is done. The larger heat energy is applied from the thermal head to the ink sheet, the larger damage the ink sheet receives and hence the less rigidity the ink sheet has.

When rewinding the ink screen area 101 after producing a print of the 1st of two screens, and then producing a print of the 2nd of the two screens, the tension applied to the ink screen area 101 does not become uniform with respect to the first scan direction. The tension T1 applied to the ink margin S and the tension T2 applied to the 1st-of-2-screens print area 102*a* from which the ink already used for printing is transferred have the following relationship: T1>T2. In this case, in 103*a* and 103*b* each of which is a boundary area between the 1st-of-2-screens print area 102*a* and the ink margin S, an ink sheet break and wrinkles easily occur due to the difference between the tensions T1 and T2. Further, because a rewind side ink area 103*c* of the 1st-of-2-screens print area 102*a* is close to the 2nd-of-2-screens print area 102*b*, wrinkles easily occur in the 2nd-of-2-screens print area 102 when the ink damage occurring in the rewind side ink area 103*c* becomes large.

A problem is that the determination method, as described in patent reference 2, of simply determining ink areas used for a print of the 1st of two screens on the basis of the density of the whole image and the average grayscale of the whole image provides a bad degree of determination precision because the ink sheet screen area has an area in which the ink sheet easily receives damage or an area in which wrinkles easily occur, and the print image quality of the 2nd of the two screens gets worse. For example, FIG. 19(*a*) shows a gray solid image of 128 levels of gray in an image having 8 bits per color (0 to 255 levels of gray) and FIG. 19(*b*) shows an image in which a left half of an image area is a solid pattern of 255 levels of gray in the image having 8 bits per color, and the average number of levels of gray in the image is 128 in both FIGS. 19(*a*) and 19(*b*). The images shown in FIGS. 19(*a*) and 19(*b*) show the results of carrying out a print experiment of transferring these two images to the 1st-of-two-screens image area 101*a* by using a conventional sublimation type thermal transfer printer. Although no problem arises in a print of the 2nd of the two screens when transferring the image pattern shown in FIG. 19(*a*), wrinkles occur in the area 103*a* when transferring the image pattern shown in FIG. 19(*b*), and print defects (transfer omission) caused by the influence of the above-mentioned wrinkles occur also in a print of the 2nd of the two screens.

The present invention is made in order to solve this problem, and it is therefore an object of the present invention to provide a print control device that can reduce wrinkles and damage occurring in an ink sheet to provide a print having good print quality, and that can improve the use efficiency of the ink sheet.

Means for Solving the Problem

In accordance with the present invention, there is provided a print control device for use in a thermal transfer printer that puts an ink sheet and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, the print control device including: an image area dividing unit for dividing an image to be printed into a plurality of areas; an ink sheet damage calculating unit for comparing image element density data of each of the areas into which the image is divided with a first threshold set correspondingly to the area to calculate the total number of pixels each having density data equal to or larger than the first threshold for each of the areas, and for comparing the total number of pixels calculated for the area with a second threshold set correspondingly to the area; and a printing operation selecting unit for using a remaining area of an already-used ink area in a unit area having the predetermined size for formation of a next print image when the calculated total number of pixels is smaller than the second threshold in every one of all the areas, and for using an ink area in a new unit for formation of a next print image when the total number of pixels is equal to or larger than the second threshold.

Advantages of the Invention

Because the print control device in accordance with the present invention uses a remaining area of an already-used ink area in a unit area having the predetermined size for formation of a next print image when the calculated total number of pixels is smaller than the second threshold in every one of all the areas, and uses an ink area in a new unit for formation of a next print image when the total number of pixels is equal to or larger than the second threshold, the number of wrinkles which occur in the ink sheet and the degree of damage which occurs in the ink sheet can be reduced and prints having high print quality can be acquired, while the use efficiency of the ink sheet can be improved.

EMBODIMENTS OF THE INVENTION

Hereafter, in order to explain this invention in greater detail, the preferred embodiments of the present invention will be described with reference to the accompanying drawings.

Embodiment 1.

In this embodiment, an example in which in a case of placing a print order to print two L size screens from ink areas each having a single 2L size screen which is provided as a unit area having a predetermined size by using an ink sheet for 2L size, the print order has an odd number of prints and is the one to print a last odd-numbered screen of the print order by using an area on an ink sheet take-up side of the ink sheet for 2L size, and print a first L size screen of a next print order will be explained.

Figure 1:
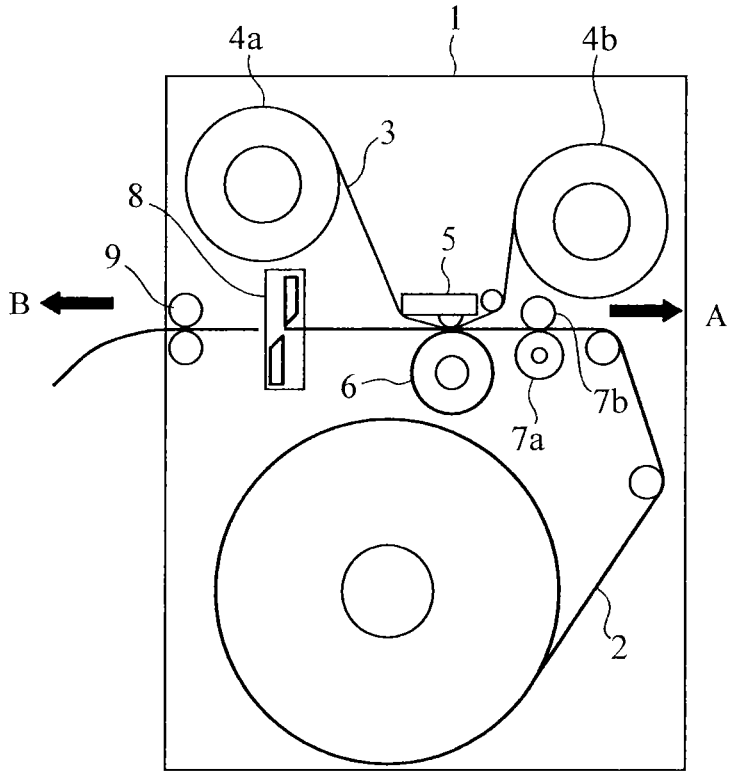
FIG. 1 is a block diagram of a thermal transfer printer to which a print control device in accordance with the present invention is applied.

FIG. 1 is a block diagram of a thermal transfer printer to which a print control device in accordance with this embodiment is applied. In FIG. 1, the printer 1 is an image forming device and a rolled paper 2 is used for a recording paper. A mechanism unit of the printer 1 is comprised of an ink sheet 3 for three-color print of yellow (Y), magenta (M), and cyan (C), an ink sheet supply reel 4*a* and an ink sheet take-up reel 4*b*, a thermal head 5 and a platen roller 6 for recording with the ink sheet 3, a grip roller 7*a* and a pinch roller 7*b* for conveying the recording paper 2, a recording paper cutting mechanism 8 for cutting the recording paper 2, and a paper ejecting roller 9.

The thermal head 5 has a plurality of heater elements in a first scan direction, and is constructed in such a way as to be able to be pressed against or detached from the platen roller 6 by a not shown driving unit. The grip roller 7*a* causes the recording paper 2 to move at a constant speed, and the pinch roller 7*b* is placed opposite to the grip roller 7*a*. The recording paper cutting mechanism 8 cuts the recording paper 2 after a print is completed, and the paper ejecting roller 9 ejects the cut recording paper 2 to outside the printer 1.

Figure 2:
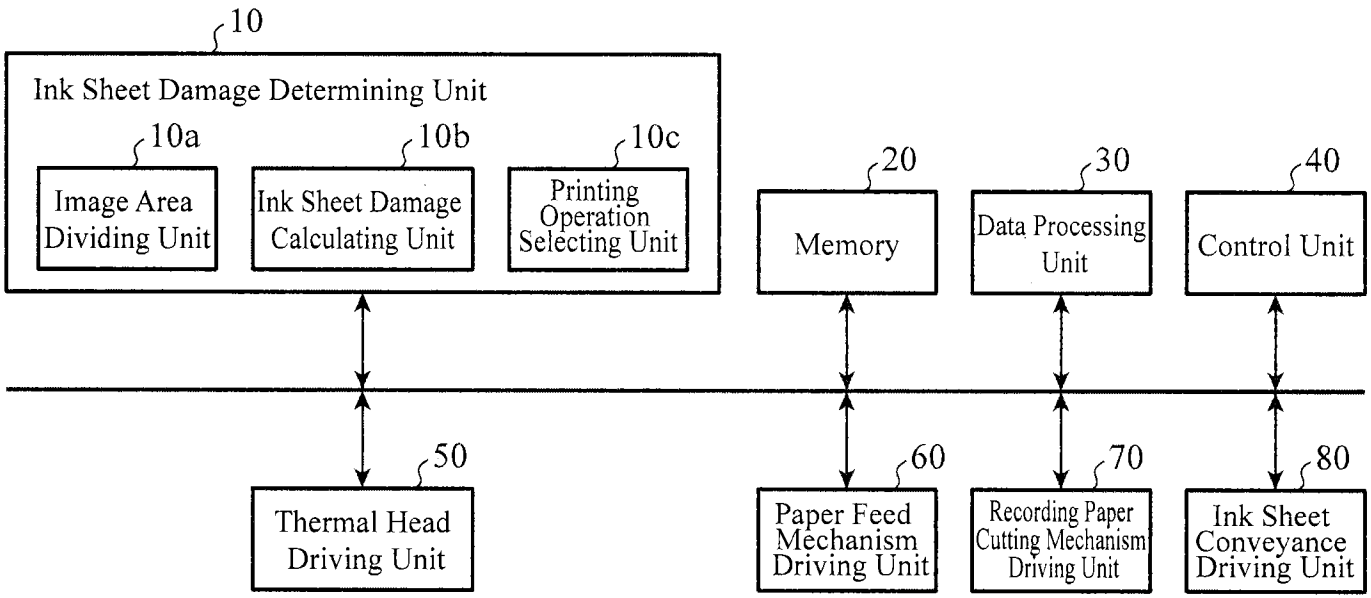
FIG. 2 is a block diagram showing the system structure of the print control device in accordance with Embodiment 1 of the present invention.

FIG. 2 is a block diagram showing the system structure of the thermal transfer printer in accordance with Embodiment 1. The system shown in this figure includes an ink sheet damage determining unit 10, a memory 20, a data processing unit 30, a control unit 40, a thermal head driving unit 50, a paper feed mechanism driving unit 60, a recording paper cutting mechanism driving unit 70, and an ink sheet conveyance driving unit 80. The ink sheet damage determining unit 10 constructs the print control device in accordance with Embodiment 1, and includes an image area dividing unit 10*a*, an ink sheet damage calculating unit 10*b*, and a printing operation selecting unit 10*c*. The image area dividing unit 10*a* has a function of dividing image data read into the memory 20 into predetermined areas, and the ink sheet damage calculating unit 10*b* has a function of comparing image density data of each pixel in each of the image areas into which the image data are divided with a first threshold set to the area to calculate the number of pixels each having density data equal to or larger than the first threshold for the area, and also comparing the total number of pixels calculated for each area with a second threshold set correspondingly to the area to calculate the degree of damage which the ink sheet 3 will receive. Further, when the total number of pixels each having density data equal to or larger than the first threshold does not exceed the second threshold in every one of the areas, the printing operation selecting unit 10*c* uses a remaining area of each already-used ink area in the unit area having the predetermined size for formation of the next print image, whereas when the plurality of areas include an area in which the total number of pixels each having density data equal to or larger than the first threshold exceeds the second threshold, the printing operation selecting unit performs a control operation of forming a print image by using a new ink unit area for formation of the next print image.

The memory 20 is a storage unit for storing image data sent thereto from an image data input unit such as a not-shown PC. The data processing unit 30 converts the image data stored in the memory 20 into print data for the printer. The thermal head driving unit 50 drives the thermal head 5 on the basis of the print data for the printer outputted thereto from the data processing unit 30. The paper feed mechanism driving unit 60 drives the grip roller 7*a* and the paper ejecting roller 9 in order to convey the recording paper 2. The recording paper cutting mechanism driving unit 70 drives the recording paper cutting mechanism 8, and the ink sheet conveyance driving unit 80 conveys the ink sheet 3. The control unit 40 controls the operation of each of the structural components including the ink sheet damage determining unit 10, the memory 20, the data processing unit 30, the thermal head driving unit 50, the paper feed mechanism driving unit 60, the recording paper cutting mechanism driving unit 70, and the ink sheet conveyance driving unit 80.

Figure 3:
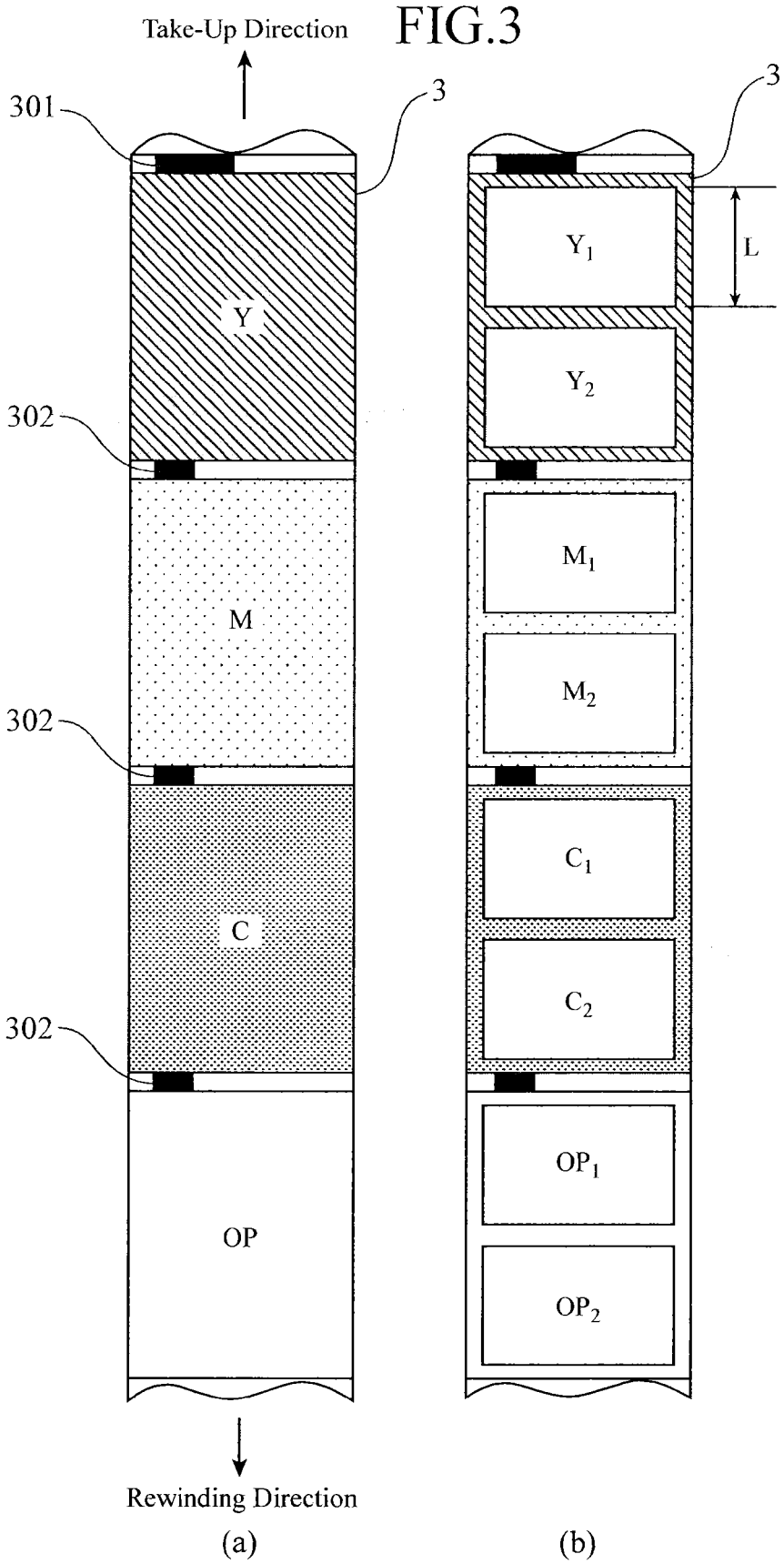
FIG. 3 is an explanatory drawing showing an ink sheet for use in the print control device in accordance with Embodiment 1 of the present invention.

FIG. 3 is a plane view of the ink sheet 3. In the ink sheet 3, ink areas of three colors and an overcoat area are arranged in order. FIG. 3(*a*) shows a 2L size ink sheet which is yet to be used for printing. In the figure, Y denotes a yellow color ink area, M denotes a magenta color ink area, C denotes a cyan color ink area, and OP denotes an overcoat area. The thermal transfer printer forms a 2L size image by using these Y, M, C, and OP areas as a single set. A marker 301 is a Y color lead position marker for Y color ink detection which is the lead position of the above-mentioned single set, and each marker 302 is a lead position marker for other ink color detection.

FIG. 3(*b*) is a diagram showing each used ink area in a case of printing two L size screens from the 2L size ink sheet, and L denotes the size of each screen in a slow scan transfer direction. Y1, M1, C1, and OP1 denote ink areas of the ink sheet 3 on a take-up side of the ink sheet 3 (a front side of the conveyance direction), and Y2, M2, C2, and OP2 denote ink areas of the ink sheet 3 on a rewind side of the ink sheet 3 (a rear side of the conveyance direction).

Figure 4:
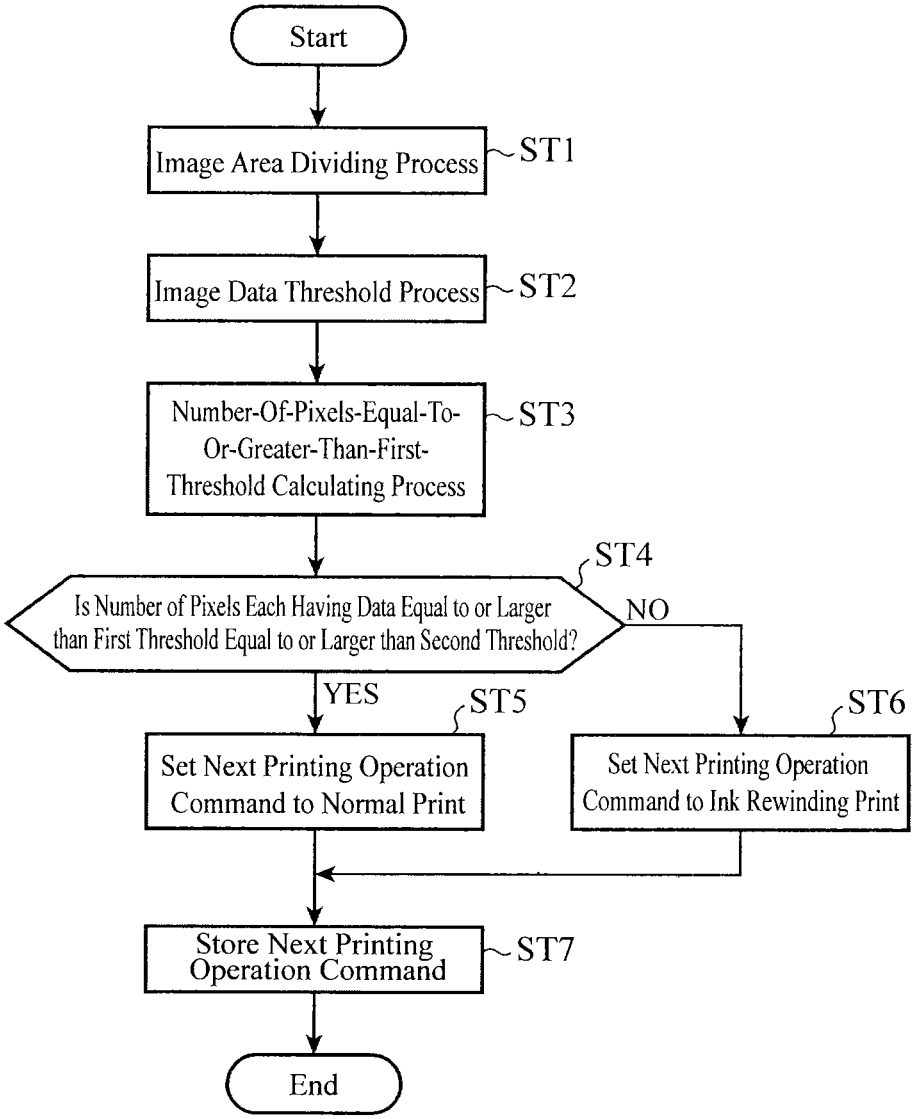
FIG. 4 is a flow chart showing a determining process of determining whether an ink sheet damage occurs in the print control device in accordance with Embodiment 1 of the present invention.

Next, an ink sheet damage determining process in accordance with Embodiment 1 will be explained. The ink sheet damage determining process in accordance with this embodiment is targeted for a last screen of a print order to print an odd number of screens. In this embodiment, a case of dividing the image area into four areas will be explained. FIG. 4 is a flow chart showing the determining process on the inputted image data for the 1st of two prints in which is carried out by the ink sheet damage determining unit 10 in accordance with Embodiment 1. First, the operation of the image area dividing unit 10*a* will be explained.

Figure 5:
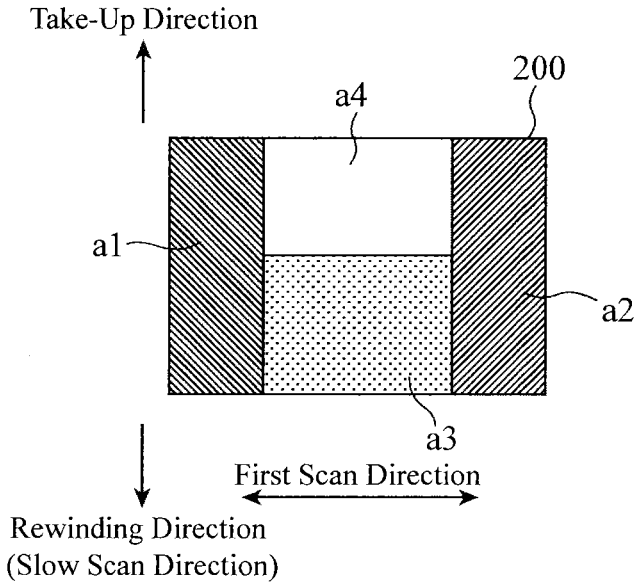
FIG. 5 is an explanatory drawing showing an example of a division of an image area in the print control device in accordance with Embodiment 1 of the present invention.
Figure 18:
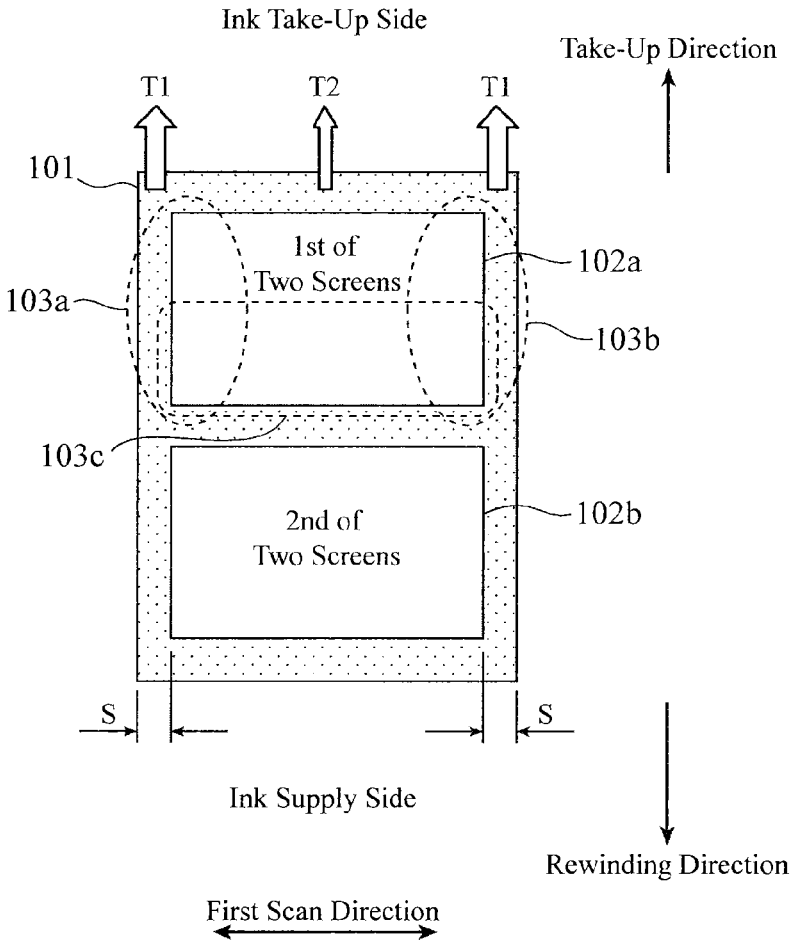
FIG. 18 is an explanatory drawing showing an ink sheet area which is vulnerable to damage.
Figure 19:
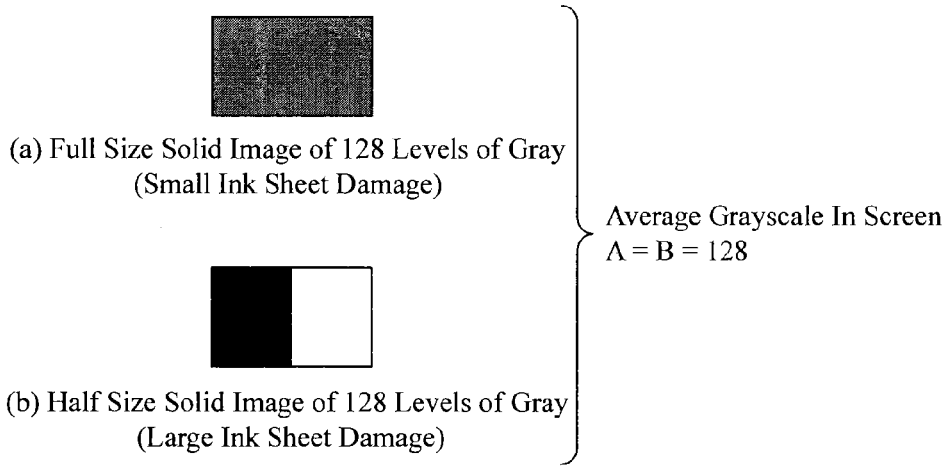
FIG. 19 is an explanatory drawing showing a difference between an image pattern and an average grayscale in a screen.
Figure 20:
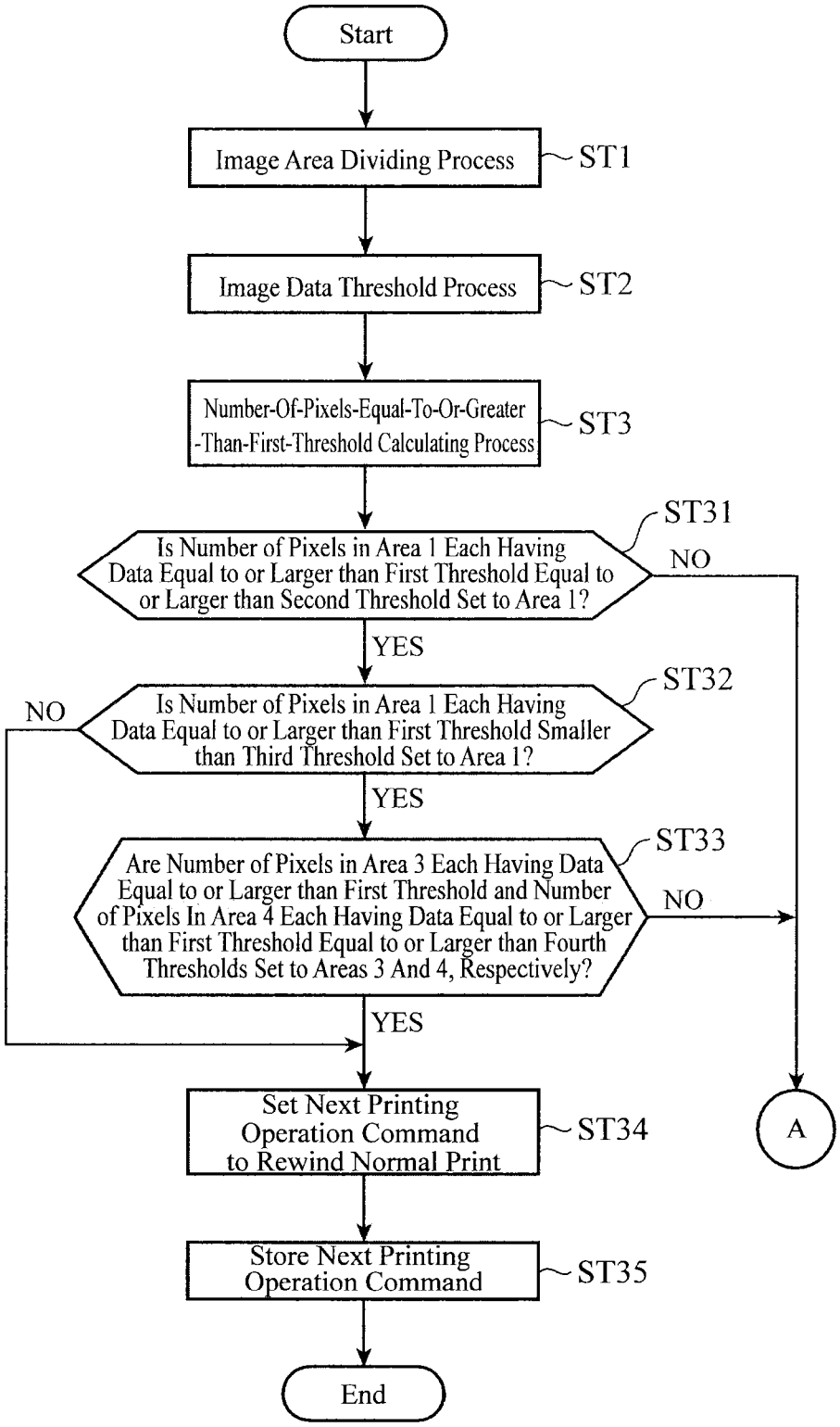
FIG. 20 is a flow chart showing a determining process of determining whether an ink sheet damage occurs in a first divided region in a print control device in accordance with Embodiment 7 of the present invention.

The image area dividing unit 10*a* divides the inputted image data into image data about the predetermined number of divided areas in an image area dividing process (step ST1). FIG. 5 is a diagram showing the state in which the image area 200 of the inputted image data is divided into four areas a1, a2, a3, and a4. The image areas a1 and a2 correspond to ink sheet areas 103*a* and 103*b* shown in FIG. 18, respectively. Each of the image areas a1 and a2 including a boundary area with an ink margin S shown in FIG. 18 is the one in which a break or a wrinkle most easily occurs in the ink sheet. Further, because the image area a3 corresponding to a position on a side of a direction of rewinding the ink sheet has a short distance to an ink sheet print area 102*b* of the 2nd of the two prints shown in FIG. 18 with respect to the slow scan direction, there is a possibility that the print image quality of the 2nd of the two prints gets worse when a large degree of damage or a large wrinkle occurs in the ink sheet area corresponding to the position of this image area a3. Because the image area a4 corresponding to a position on a side of a direction of taking up the ink sheet has a long distance from the ink margin S with respect to the first scan direction, and also has a long distance to an ink sheet print area 102*b* of the 2nd of the two prints with respect to the slow scan direction, there is a low possibility that even if the ink sheet in this image area a4 receives a certain degree of damage, an influence is exerted upon the print image quality of the 2nd of the two prints.

These areas a1, a2, a3, and a4 are sorted in descending order of the influence exerted upon the print image quality of the 2nd of the two prints as follows:

$$a1=a2>a3>a4$$

Further, first thresholds Th11, Th12, Th13, and Th14 and second thresholds Th21, Th22, Th23, and Th24 are set to the areas a1, a2, a3, and a4, respectively. These thresholds are determined according to conditions including the type of the ink sheet and a grayscale table for determining the energy applied from the thermal head 5 to the ink sheet, and can be predetermined from the results of carrying out an experiment on each of the conditions.

Next, the operation of the ink sheet damage calculating unit 10*b* will be explained. The ink sheet damage calculating unit 10*b* calculates the degree of damage which the ink sheet will receive quantitatively. In an image data threshold process (step ST2), the ink sheet damage calculating unit 10*b* compares the image element data about each image element in each divided image area with the first threshold set to the divided area to carry out a binarization process on the image element. More specifically, the ink sheet damage calculating unit compares the image element data about each image element in the area a1 with the threshold Th11, compares the image element data about each image element in the area a2 with the threshold Th12, compares the image element data about each image element in the area a3 with the threshold Th13, and compares the image element data about each image element in the area a4 with the threshold Th14 to carry out a binarization process on each image element in each area. For example, the ink sheet damage calculating unit processes all the pixels in each area in such a way as to set each pixel having a value equal to or larger than the first threshold to "255" and also set each pixel having a value smaller than the first threshold to "0." The ink sheet damage calculating unit carries out these processes on Y data, M data, and C data of each area.

Next, in a number-of-pixels-equal-to-or-greater-than-first-threshold calculating process (step ST3), the ink sheet damage calculating unit 10*b* calculates the total number of pixels each having a value equal to or larger than the first threshold for each of Y, M, and C data on which the binarization process has been carried out in the image data threshold process (step ST2). Hereafter, the number of pixels each having a value equal to or larger than the first threshold for each of the Y, M, and C colors in the area a1 are expressed as San, Sa1M, and Sa1C, respectively, the number of pixels each having a value equal to or larger than the first threshold for each of the Y, M, and C colors in the area a2 are expressed as Sa2Y, Sa2M, and Sa2C, respectively, the number of pixels each having a value equal to or larger than the first threshold for each of the Y, M, and C colors in the area a3 are expressed as Sa3Y, Sa3M, and Sa3C, respectively, and the number of pixels each having a value equal to or larger than the first threshold for each of the Y, M, and C colors in the area a4 are expressed as Sa4Y, Sa4M, and Sa4C, respectively.

After completing the number-of-pixels-equal-to-or-greater-than-first-threshold calculating process (step ST3), in an ink sheet damage determining process (step ST4), the ink sheet damage calculating unit 10*b* compares the number of pixels each having a value equal to or larger than the first threshold in each area, which is determined in the number-of-pixels-equal-to-or-greater-than-first-threshold calculating process (step ST3), with the second threshold. The ink sheet damage calculating unit compares each of the numbers of pixels Sa1Y, Sa1M, and Sa1C in the area a1, each pixel having a value equal to or larger than the first threshold, with the second threshold Th21, compares each of the numbers of pixels Sa2Y, Sa2M, and Sa2C in the area a2, each pixel having a value equal to or larger than the first threshold, with the second threshold Th22, compares each of the numbers of pixels Sa3Y, Sa3M, and Sa3C in the area a3, each pixel having a value equal to or larger than the first threshold, with the second threshold Th23, and compares each of the numbers of pixels Sa4Y, Sa4M, and Sa4C in the area a4, each pixel having a value equal to or larger than the first threshold, with the second threshold Th24.

Next, the operation of the printing operation selecting unit 10*c* will be explained. The printing operation selecting unit 10*c* determines the degree of damage which the ink sheet will receive to determine the first printing operation to be performed of the next print order. When even one of the results of the comparison cases shows that the number of pixels is equal to or larger than the second threshold in the above-mentioned ink sheet damage determining process (step ST4), the printing operation selecting unit determines that the degree of damage which the ink sheet will receive is large, and then determines that the first printing operation command for the next print order is a "normal print" in a next printing operation command determining process (step ST5). In contrast, when all of the results of the comparison cases show that every one of the numbers of pixels in each area is smaller than the second threshold in the process of step ST4, the printing operation selecting unit determines that the degree of damage which the ink sheet will receive is small, and then determines that the first printing operation command for the next print order is an "ink rewinding print" in the next printing operation command determining process (step ST6). The printing operation command determined is then stored until the next print order is inputted in a next printing operation command storing process (step ST7).

Figure 6:
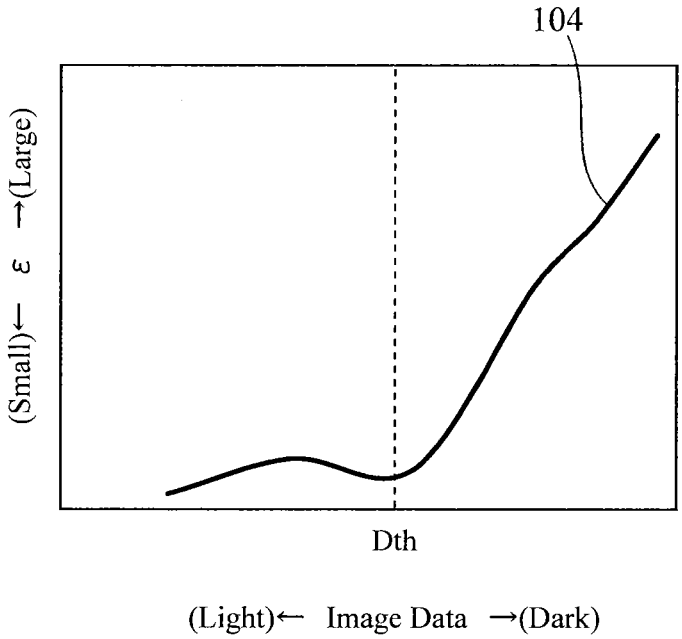
FIG. 6 is an explanatory drawing showing an relationship between image data and an ink sheet distortion.

Hereafter, the necessity to set up the second thresholds Th21 to Th24 will be explained with reference to FIG. 6. FIG. 6 is a diagram showing a relationship between the image data (the number of levels of gray) and a distortion ϵ occurring in the ink sheet on which a transfer has been carried out. In the figure, a curved line 104 shows the relationship between the image data and the distortion ϵ occurring in the ink sheet on which a transfer has been carried out. When the ink sheet has a large amount of heat energy applied thereto from the thermal head, that is, when the degree of damage which the ink sheet will receive is large, a distortion (elongation) ϵ occurs in the ink sheet on which a transfer has been carried out. As shown in FIG. 6, the distortion ϵ which occurs in the ink sheet becomes large steeply when the image data have a value of Dth. When the image data have a high density (high applied energy) higher than this value of Dth, wrinkles easily occur in the ink sheet, whereas when the image data have a density lower than Dth, the degree of damage which the ink sheet will receive is small and wrinkles hardly occur in the ink sheet. More specifically, because the larger number of pixels each having image data exceeding the image data value Dth are included, the larger degree of damage the ink sheet receives, the printing operation selecting unit can determine the degree of damage which the ink sheet will receive from the number of pixels each having image data exceeding the image data value Dth. In this embodiment, the image data value Dth corresponds to the first threshold, and the number of pixels each having a value exceeding Dth corresponds to the second threshold.

Next, the printing operation of the printer 1 in accordance with Embodiment 1 will be explained. First, an operation of forming a color image of the last screen (an odd-numbered screen) of the print order by using the take-up side ink areas Y1, M1, and C1 as shown in FIG. 3(*b*), and transferring an overcoat by using OP1 will be explained. In a state before the printing operation is performed, the ink sheet 3 is placed in such a way as to pass through between the thermal head 5 and the platen rollers 6, and the recording paper 2 is in a state in which the recording paper passes through between the ink sheet 3 and the platen rollers 6 and is sandwiched between the grip roller 7*a* and the pinch roller 7*b*.

The thermal head 5 is pressed against the platen roller 6 by a not shown driving unit in such a way as to bring the ink sheet 3 and the recording paper 2 into intimate contact with each other. In this state, a not shown detecting unit detects a Y color lead position marker 301 of the ink sheet 3, and a not shown driving unit moves the ink sheet in such a way that the position of Y color matches the print starting position of Y color (the heater element line position of the thermal head 5).

The inputted image data are stored in the memory 20 and are converted into data for printing by the data processing unit 30. The control unit 40 then controls the thermal head driving unit 50, the paper feed mechanism driving unit 60, the recording paper cutting mechanism driving unit 70, and the ink sheet conveyance driving unit 80, and carries out the printing operation.

When the printing operation is started, the grip roller 7*a* starts conveying the recording paper 2 in a direction of the printing (a direction of A shown in FIG. 1), and the thermal head 5 simultaneously starts printing an image of Y color on the recording paper 2. At this time, the thermal head driving unit 50 drives the thermal head 5 on the basis of the print data outputted thereto from the data processing unit 30, and the thermal head 5 applies the ink of the ink sheet 3 onto the recording paper 2 on a per line basis. The ink sheet take-up reel 4*b* takes up the ink sheet 3 whose ink has been applied onto the recording paper.

After printing the image of Y color, the thermal head 5 is detached from the ink sheet by the not shown driving unit, and the grip roller 7*a* conveys the recording paper 2 to the print starting position in an ejecting direction (a direction of B shown in FIG. 1). Further, the printing control device detects an M color lead position marker 302 of the ink sheet 3 with which the print of the image of Y color has been completed by using the not shown detecting unit, and the ink sheet take-up reel 4*b* takes up the ink sheet in such a way that the lead position of M color matches the print starting position.

After that, like in the case of performing the printing operation of printing an image of Y color, the thermal head 5 is pressed against the platen roller 6, the grip roller 7*a* starts conveying the recording paper 2 in the direction of the printing (the direction of A shown in FIG. 1), and the thermal head 5 starts printing an image of M color. After completing the image of M color, the printing control device carries out the same operation as that which the printing control device has carried out after completing the image of Y color, the grip roller 7*a* conveys the recording paper 2 to the print starting position, and the thermal head 5 carries out a print of an image of C color and a transfer of OP by performing the same printing operation as those which the thermal head has carried out when printing the images of Y color and M color.

After completing the prints of Y, M, and C colors and the transfer of OP, the thermal head 5 is detached from the ink sheet by the not shown driving unit, and the grip roller 7*a* conveys the recording paper 2 in the ejecting direction (the direction of B shown in FIG. 1). When the print lead position of the recording paper 2 reaches the recording paper cutting mechanism 8 on the conveying path, the grip roller 7*a* stops conveying the recording paper, the recording paper cutting mechanism 8 cuts the recording paper 2 along the first scan direction, and the paper ejecting roller 9 ejects the recording paper 2 to outside the printer 1. In the above-mentioned way, the printing operation using the take-up side ink areas Y1, M1, C1, and OP1 is carried out on the last screen (an odd-numbered screen) of the print order. Next, the first L size screen printing operation of the next print order will be explained.

Figure 7:
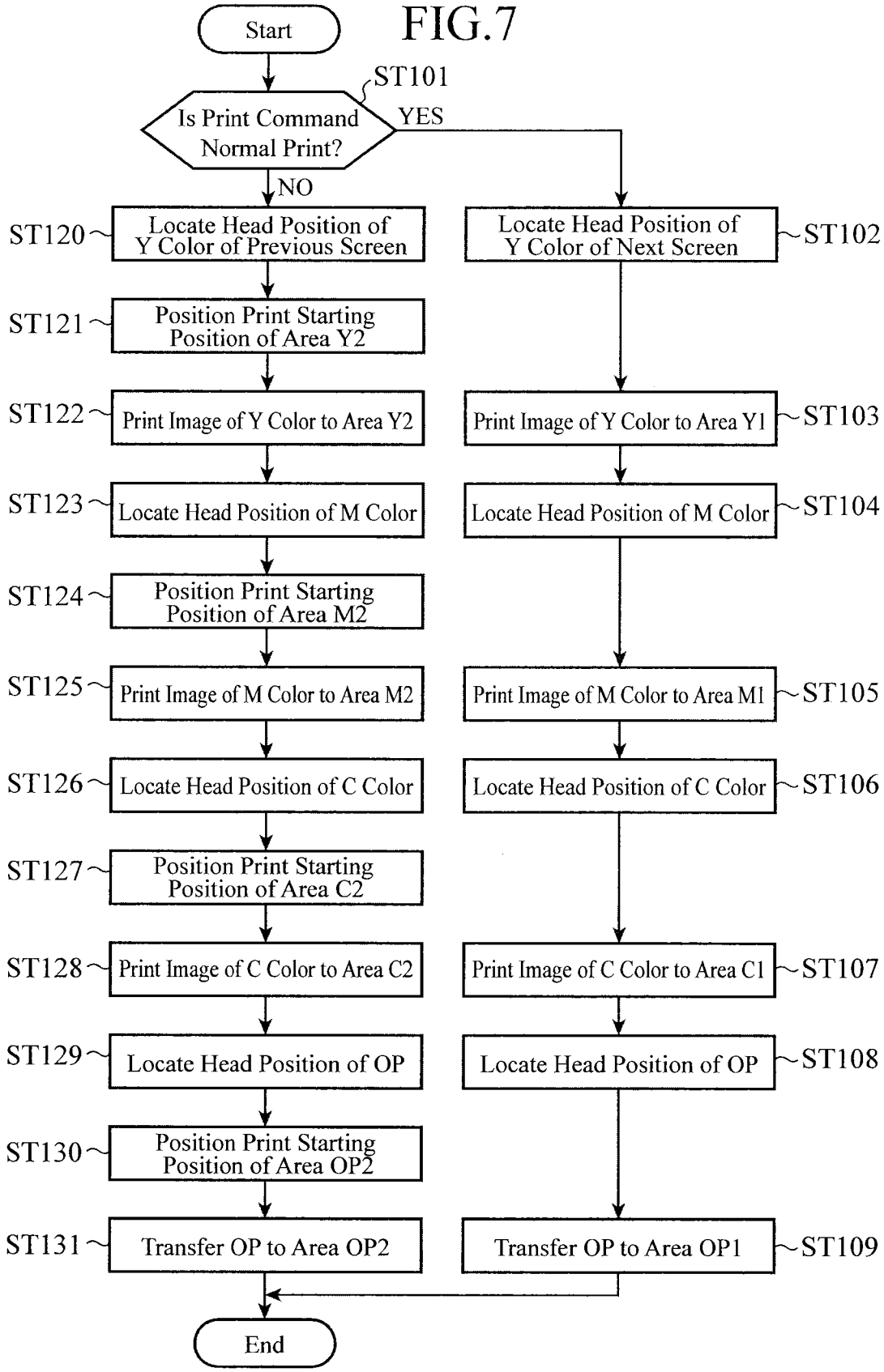
FIG. 7 is a flow chart showing an ink area selecting process and an ink conveying process carried out by the print control device in accordance with Embodiment 1 of the present invention.

FIG. 7 is a flow chart showing a selection of ink areas used for printing of the first L size screen of the next print order, and an ink conveying operation. First, a next print order printing operation command stored in the printing operation selecting unit 10*c* is sent to the control unit 40. The control unit 40 determines whether or not the printing operation command is a "normal print" (step ST101). When the printing operation command is a "normal print", the ink sheet 3 is forwarded in an ink take-up direction until the Y color lead position marker 301 of the next ink screen is detected by the not shown detecting unit (step ST102). Y color data is printed to the take-up side ink area Y1, like in the case in which the printing operation is carried out on the last screen of the previous print order (step ST103). Also in the subsequent operations of printing images of M color and C color, and performing a transfer of OP, the printing operations using M1, C1, and OP1 are carried out after an operation of locating the lead position of each color is carried out, like in the case of carrying out the printing operation on the last screen of the previous print order (steps ST104 to ST109).

Next, the case in which the printing operation command sent to the control unit 40 is an "ink rewinding print" will be explained. When the printing operation command is not a "normal print", that is, when the printing operation command is an "ink rewinding print", the not shown driving unit drives the ink sheet supply reel 4*a* in the direction of rewinding the ink sheet 3 to cause the ink sheet supply reel to rewind the ink sheet 3 until the not shown detecting unit detects the Y color lead position marker 301 of the ink screen which has been used last time for the previous print order (step ST120). When the Y color lead position marker 301 is detected, the not shown driving unit stops driving the ink sheet supply reel 4*a*, and drives the ink sheet take-up reel 4*b* to cause the ink sheet take-up reel to take up the ink sheet 3 until the heater element line position of the thermal head 5 matches the print starting position of the rewind side ink area Y2 which is a yet-to-be-used ink area to position the print starting position of the rewind side ink area Y2 (step ST121). Positioning the print starting position of this rewind side ink area Y2 at the heater element line position of the thermal head 5 is carried out by measuring the distance of conveyance of the ink sheet 3 using a not shown encoder.

Next, the printing operation of printing an image of Y color is carried out by using the rewind side ink area Y2 (step ST122). In the subsequent operations of printing images of M color and C color, and performing a transfer of OP, after each color lead position marker 302 is detected, the ink sheet 3 is taken up until the heater element line position of the thermal head 5 matches the print starting position of the rewind side ink area of each color, and the printing operations using the ink areas M2, C2, and OP2 are carried out (steps ST123 to ST131).

In accordance with Embodiment 1, because the image data are divided into areas in each of which the ink sheet will easily receive damage, and the degree of damage which the ink sheet will receive is determined for each of the divided areas, the degree of damage which the ink sheet will receive can be determined with a high degree of accuracy. Further, because ink areas used for the first printing of the next print order are selected on the basis of the results of the above-mentioned determination, the number of wrinkles which occur in the ink sheet and the degree of damage which occurs in the ink sheet can be reduced and prints having high print quality can be acquired, while the use efficiency of the ink sheet can be improved.

Although the first and second thresholds set in the ink sheet damage calculating unit 10*b* are made to be used in common for Y, M, and C colors in Embodiment 1, a threshold for each color can be set up individually, thereby making it possible to determine the degree of damage which the ink sheet will receive with a higher degree of accuracy. Further, the ink sheet damage determining unit 10 in accordance with Embodiment 1 can be disposed in an image input device that inputs image data to the printer 1, such as a computer. In this case, the ink sheet damage determining unit 10 can be implemented by installing the function of the ink sheet damage determining unit 10 in a driver for the printer 1 as software.

As previously explained, in accordance with Embodiment 1, because there is provided a print control device for use in a thermal transfer printer that puts an ink sheet and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, the print control device including: an image area dividing unit for dividing an image to be printed into a plurality of areas; an ink sheet damage calculating unit for comparing image element density data of each of the areas into which the image is divided with a first threshold set correspondingly to the area to calculate the total number of pixels each having density data equal to or larger than the first threshold for each of the areas, and for comparing the total number of pixels calculated for the area with a second threshold set correspondingly to the area; and a printing operation selecting unit for using a remaining area of an already-used ink area in a unit area having the predetermined size for formation of a next print image when the calculated total number of pixels is smaller than the second threshold in every one of all the areas, and for using an ink area in a new unit for formation of a next print image when the total number of pixels is equal to or larger than the second threshold, the number of wrinkles which occur in the ink sheet and the degree of damage which occurs in the ink sheet can be reduced and prints having high print quality can be acquired, while the use efficiency of the ink sheet can be improved.

Embodiment 2.

The case of selecting ink areas used for the first printing of the next print order is shown in above-mentioned Embodiment 1. In contrast with this, in this Embodiment 2, a case in which the number of screens of the current print order is odd, and ink areas used for the printing of a last odd-numbered screen of a current print order are selected will be explained. A mechanism unit of a thermal transfer printer in accordance with this Embodiment 2 has the same structure as that in accordance with Embodiment 1. Further, because the thermal transfer printer in accordance with this Embodiment 2 has the same system structure as that in accordance with Embodiment 1 from a graphical viewpoint, the system structure will be explained with reference to the structure shown in FIG. 2. While an ink sheet damage determining unit 10 in accordance with Embodiment 2 has the same basic structure as that in accordance with Embodiment 1, the ink sheet damage determining unit in accordance with Embodiment 2 differs from that in accordance with Embodiment 1 in that a selection of a printing operation which is carried out by a printing operation selecting unit 10*c* is targeted for the last odd-numbered print of the current print order. More specifically, the printing operation selecting unit 10*c* in accordance with Embodiment 2 is constructed in such a way as to, when a plurality of areas include an area in which the total number of pixels calculated by an ink sheet damage calculating unit 10*b* is equal to or larger than a second threshold, carry out a control operation of using an ink area on a rear side of a conveyance direction in a unit area having a predetermined size for formation of a target print image, whereas when the total number of pixels calculated for every one of all the areas is smaller than the second threshold, carry out a control operation of using an ink area on a front side of the conveyance direction in the unit area having the predetermined size for formation of a target print image.

Figure 8:
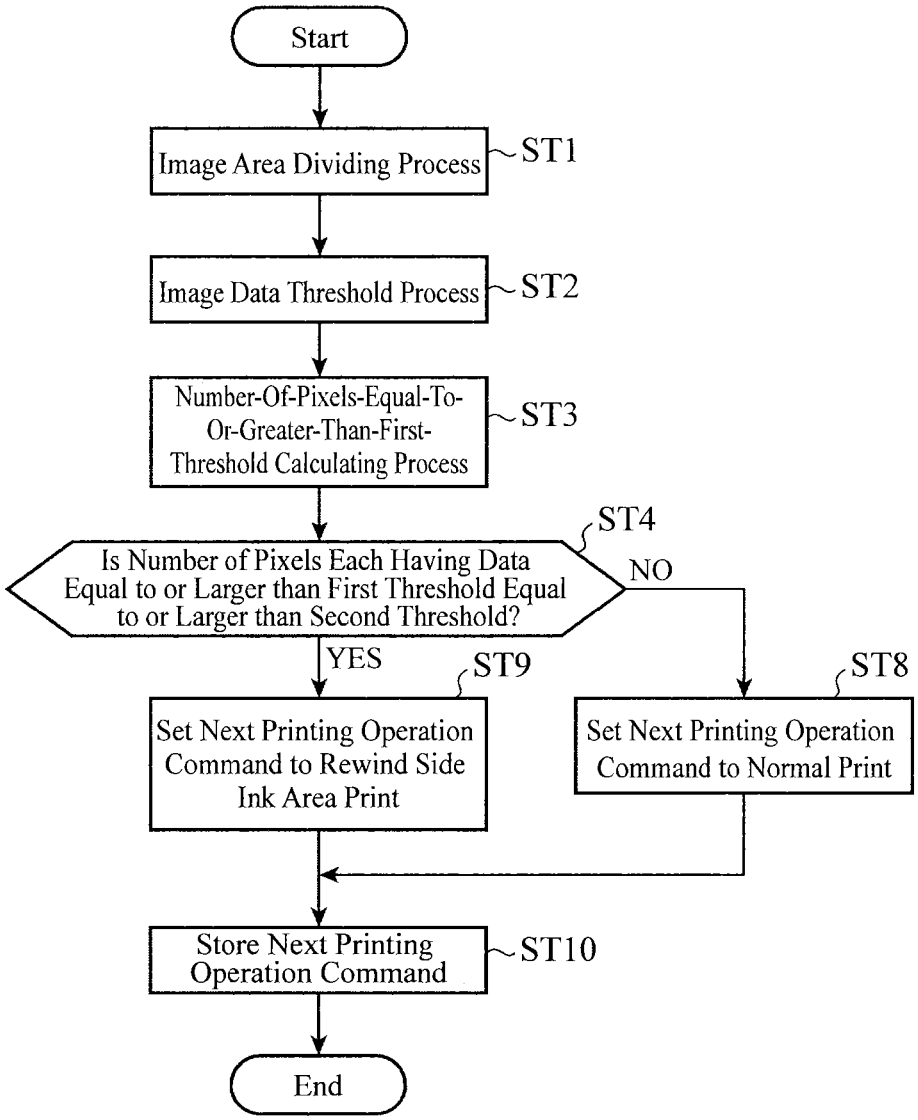
FIG. 8 is a flow chart showing a determining process of determining whether an ink sheet damage occurs in a print control device in accordance with Embodiment 2 of the present invention.

Next, a method of determining the degree of damage which an ink sheet will receive in accordance with this Embodiment 2 will be explained. FIG. 8 is a flow chart showing a determining process on inputted image data for the last odd-numbered print of the current print order, which is carried out by the ink sheet damage determining unit 10 in accordance with this Embodiment 2. This process is carried out before the last odd-numbered print of the current print order is produced. First, an image area dividing unit 10*a* divides the last odd-numbered image data of the current print order into image data about a predetermined number of areas in an image area dividing process (step ST1). Because an image data threshold process (step ST2) and a number-of-pixels-equal-to-or-greater-than-first-threshold calculating process (step ST3), which are carried out by the ink sheet damage calculating unit 10*b* after the image area dividing process, are the same as those in accordance with Embodiment 1, a detailed explanation of these processes will be omitted hereafter.

Next, the operation of the printing operation selecting unit 10*c* will be explained. The printing operation selecting unit 10*c* determines the last odd-numbered printing operation of the current print order. When at least one of the results of comparison cases shows that the number of pixels is equal to or larger than the second threshold in an ink sheet damage determining process (step ST4), the printing operation selecting unit 10*c* determines that the degree of damage which the ink sheet will receive is large, and then determines that the last printing operation command for the current print order is a "rewind side ink area print" in a printing operation command determining process (step ST9). In contrast, when all of the results of the comparison cases show that the number of pixels is smaller than the second threshold, the printing operation selecting unit determines that the degree of damage which the ink sheet will receive is small, and then determines that the last printing operation command for the current print order is a "normal print" in the printing operation command determining process (step ST8). The printing operation command determined is then stored as the last odd-numbered printing operation command for the current print order in a printing operation command storing process (step ST10).

Next, the printing operation of the printer 1 in accordance with Embodiment 2 will be explained. Before the last odd-numbered print of the current print order is produced, the printing operation command stored in the printing operation selecting unit 10*c* and determined in a current print order printing operation selecting process (step ST4) is sent to a control unit 40. When the printing operation command sent to the control unit 40 is a "normal print", a print of an image of Y color is produced by using a take-up side ink area Y1 of the next ink screen after a not shown detecting unit detects a Y color lead position marker 301 of the next ink screen. After that, in the subsequent operations of printing images of M color and C color, and performing a transfer of OP, printing operations using M1, C1, and OP1 are carried out.

Next, the case in which the printing operation command sent to the control unit 40 is a "rewind side ink area print" will be explained. When the printing operation command is a "rewind side ink area print", after the not shown detecting unit detects a Y color lead position marker 301 of the next ink screen, a not shown driving unit drives an ink sheet take-up reel 4*b* in a direction of taking up the ink sheet 3 to cause the ink sheet take-up reel to take up the ink sheet 3 until the heater element line position of a thermal head 5 matches the print starting position of a rewind side ink area Y2 to position the print starting position of the rewind side ink area Y2. Next, the printing operation of printing the image of Y color is carried out by using the rewind side ink area Y2.

In the subsequent operations of printing images of M color and C color, and performing a transfer of OP, after each color lead position marker 302 is detected, the ink sheet 3 is taken up until the heater element line position of the thermal head 5 matches the print starting position of the rewind side ink area of each color, and the printing operations using ink areas M2, C2, and OP2 are carried out. The above-mentioned printing operation of producing the last print of the current print order in accordance with Embodiment 2 is nearly the same as the ink area selecting process and the ink conveying process for a first print of a next print order, which are carried out by the print control device in accordance with Embodiment 1 shown in FIG. 7. This embodiment differs from Embodiment 1 in that while the last print command of the previous print order is referred to in step ST101 in Embodiment 1, the last odd-numbered print command of the current print order is referred to and the processes of steps ST120 to ST131 are carried out on the next ink screen in this embodiment.

Figure 9:
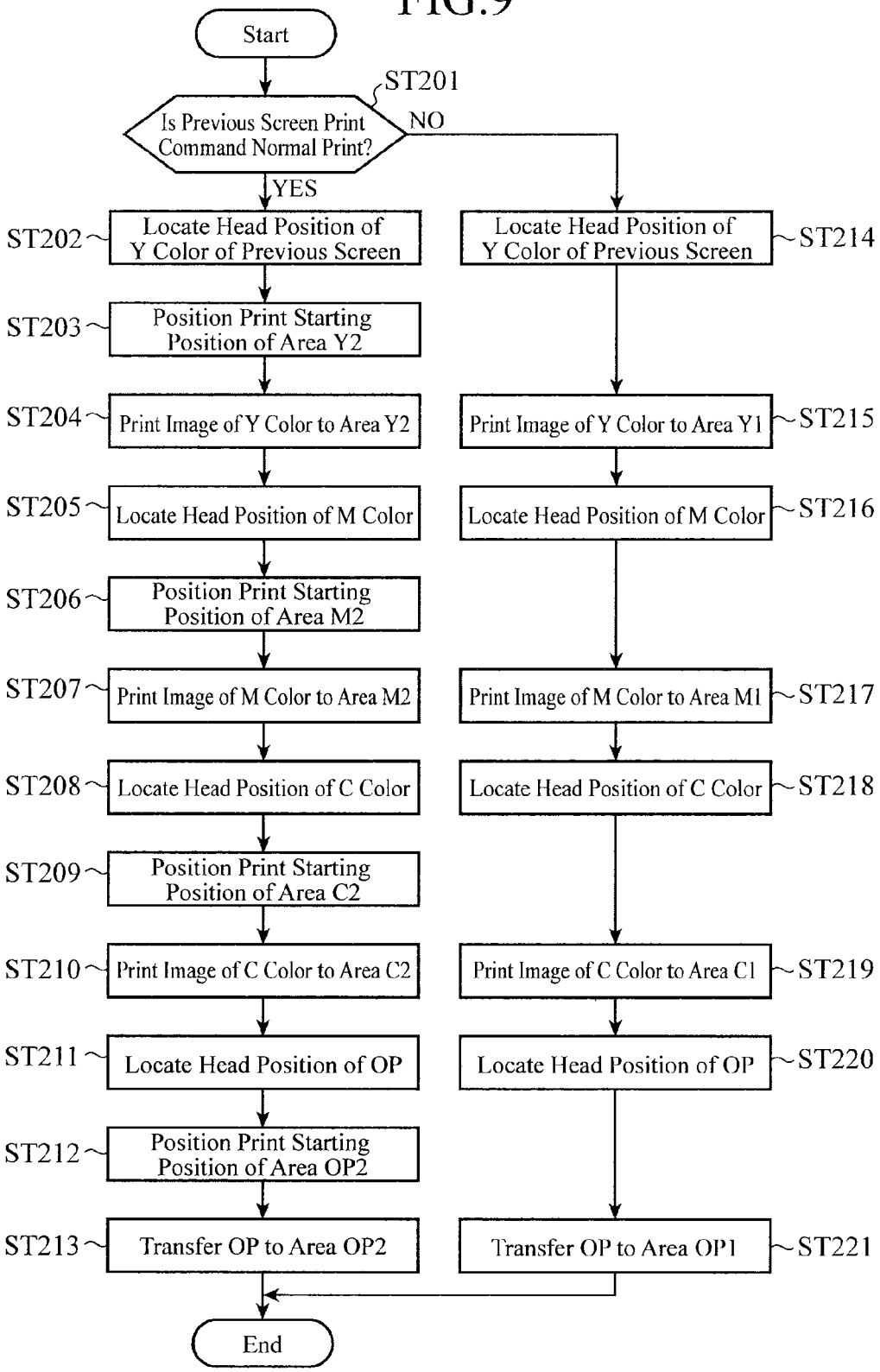
FIG. 9 is a flow chart showing an ink area selecting process and an ink conveying process carried out by the print control device in accordance with Embodiment 2 of the present invention.

Next, the printing operation of producing the first print of the next print order will be explained. FIG. 9 is a flow chart showing a selection of ink areas used for the first print of an L size screen of the next print order, and an ink conveying operation. First, a printing operation command for producing the last print of the previous print order, which is stored in the printing operation selecting unit 10*c*, is sent to the control unit 40. The control unit 40 determines whether or not the printing operation command is a "normal print" (step ST201). When the printing operation command is not a "normal print", that is, when the last print of the previous print order is produced by using a rewind side ink area, the not shown driving unit drives the ink sheet supply reel 4*a* in the direction of rewinding the ink sheet 3 to cause the ink sheet supply reel to rewind the ink sheet 3 until the not shown detecting unit detects a Y color lead position marker 301 of the previous ink screen (step ST214). When the not shown detecting unit then detects a Y color lead position marker 301 of the previous ink screen, the not shown driving unit stops driving the ink sheet supply reel 4*a*, and the print control device carries out printing of Y color data using a take-up side ink area Y1 which is a yet-to-be used area of the previous ink screen (step ST215). In the subsequent operations of printing images of M color and C color, and performing a transfer of OP, the printing operations using M1, C1, and OP1 are carried out after an operation of locating the lead position of each color is carried out (steps ST216 to ST221).

Next, the case in which the printing operation command for producing the last print of the previous print order, which is sent to the control unit 40, is a "normal print" will be explained. When the printing operation command for producing the last print of the previous print order is a "normal print", the not shown driving unit drives the ink sheet supply reel 4*a* in the direction of rewinding the ink sheet 3 to cause the ink sheet supply reel to rewind the ink sheet 3 until the not shown detecting unit detects the Y color lead position marker 301 of the ink screen which has been used last time for the previous print order (step ST202). When the Y color lead position marker 301 is detected, the not shown driving unit stops driving the ink sheet supply reel 4*a*, and then drives the ink sheet take-up reel 4*b* to cause the ink sheet take-up reel to take up the ink sheet 3 until the heater element line position of the thermal head 5 matches the print starting position of the rewind side ink area Y2 which is a yet-to-be-used ink area to position the print starting position of the rewind side ink area Y2 (step ST203). Next, the printing operation of printing an image of Y color is carried out by using the rewind side ink area Y2 which is a yet-to-be-used area of the previous ink screen (step ST204). In the subsequent operations of printing images of M color and C color, and performing a transfer of OP, after each color lead position marker 302 is detected, the ink sheet 3 is taken up until the heater element line position of the thermal head 5 matches the print starting position of the rewind side ink area of each color, and the printing operations using the ink areas M2, C2, and OP2 are carried out (steps ST205 to ST213).

Thus, when it is determined that the degree of damage which the ink sheet will receive due to the last odd-numbered print of the current print order is small, the print control device in accordance with Embodiment 2 carries out image formation of the last odd-numbered print of the current print order by using the take-up side ink areas Y1, M1, C1, and OP1, like in the case of performing a normal printing operation, and, when producing the first screen print of the next print order, rewinds the ink sheet and forms an image by using the rewind side ink areas Y2, M2, C2, and OP2 which are yet-to-b-used areas of the previous ink screen. In contrast, when it is determined that the degree of damage which the ink sheet will receive due to the last odd-numbered print of the current print order is large, the print control device carries out image formation of the last odd-numbered print of the current print order by using the rewind side ink areas Y2, M2, C2, and OP2, and, when producing the first screen print of the next print order, rewinds the ink sheet and forms an image by using the take-up side ink areas Y1, M1, C1, and OP1 which are yet-to-b-used areas of the previous ink screen. Therefore, because the print control device can carry out the first printing of the next print order and can use all the ink screen areas of the previous print order regardless of the degree of damage occurring in the ink sheet without being affected by the damage occurring in the ink sheet due to the last odd-numbered print of the previous print order, the ink use efficiency can be improved.

As previously explained, in accordance with Embodiment 2, because there is provided a print control device for use in a thermal transfer printer that puts an ink sheet and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, the print control device including: an image area dividing unit for dividing an image to be printed into a plurality of areas; an ink sheet damage calculating unit for comparing image element density data of each of the areas into which the image is divided with a first threshold set correspondingly to the area to calculate the total number of pixels each having density data equal to or larger than the first threshold for each of the areas, and for comparing the total number of pixels calculated for the area with a second threshold set correspondingly to the area; and a printing operation selecting unit for, when the plurality of areas include an area in which the calculated total number of pixels is equal to or larger than the second threshold, carrying out a control operation of using an ink area on a rear side of the conveyance direction in a unit area having the predetermined size for formation of a target print image, and, when the calculated total number of pixels is smaller than the second threshold in every one of all the areas, carrying out a control operation of using an ink area on a front side of the conveyance direction in a unit area having the predetermined size for the formation of the target print image, the number of wrinkles which occur in the ink sheet and the degree of damage which occurs in the ink sheet can be reduced and prints having high print quality can be acquired, while the use efficiency of the ink sheet can be improved.

Embodiment 3.

In above-mentioned Embodiments 1 and 2, the determination of ink screen areas is carried out according to a selection between two alternatives: whether the ink sheet damage is large or small. In contrast, in Embodiment 3, a determining method of determining ink screen areas used for a last screen print of a current print order according to a selection between three alternatives: whether the ink sheet damage is "large", "medium", or "small", and a determining method of determining ink screen areas used for a first print of a next print order according to a selection between three alternatives: whether the ink sheet damage is "large", "medium", or "small" will be explained.

A thermal transfer printer in accordance with this Embodiment 3 has the same mechanism structure as that in accordance with Embodiment 1. The thermal transfer printer in accordance with this Embodiment 3 also has the same system structure as that in accordance with Embodiment 1 fundamentally. The thermal transfer printer in accordance with this Embodiment 3 differs from that in accordance with Embodiment 1 in that an ink sheet damage calculating unit 10*b* calculates the degree of damage which an ink sheet 3 will receive on the basis of first through third thresholds, and a selection of a printing operation carried out by a printing operation selecting unit 10*c* is targeted for both the last odd-numbered print of the current print order and the first print of the next print order. More specifically, the ink sheet damage calculating unit 10*b* in accordance with Embodiment 3 is constructed in such a way as to compare image element density data of each of areas into which an inputted image is divided by an image area dividing unit 10*a* with a first threshold set correspondingly to the area to calculate the total number of pixels each having density data equal to or larger than the first threshold for each of the areas, and compare the total number of pixels calculated for each of the areas with both a second threshold set correspondingly to the area, and a third threshold larger than the second threshold. Further, a printing operation selecting unit 10*c* carries out a control operation of forming a print image by using an ink area in a unit area having a predetermined size on a rear side of a conveyance direction and then forming the next print image by using an ink area on a front side of the conveyance direction when the plurality of areas include an area in which the calculated total number of pixels is equal to or larger than the second threshold and is smaller than the third threshold, forming a print image by using an ink area on a front side of the conveyance direction and then forming the next print image by using an ink area on a rear side of the conveyance direction when the calculated total number of pixels calculated for every one of all the areas is smaller than the second threshold, and forming a print image by using an ink area in a unit area having the predetermined size on a front side of the conveyance direction and then forming the next print image by using ink area in a new unit area when the calculated total number of pixels is equal to or larger than the third threshold in either one of the areas.

Figure 10:
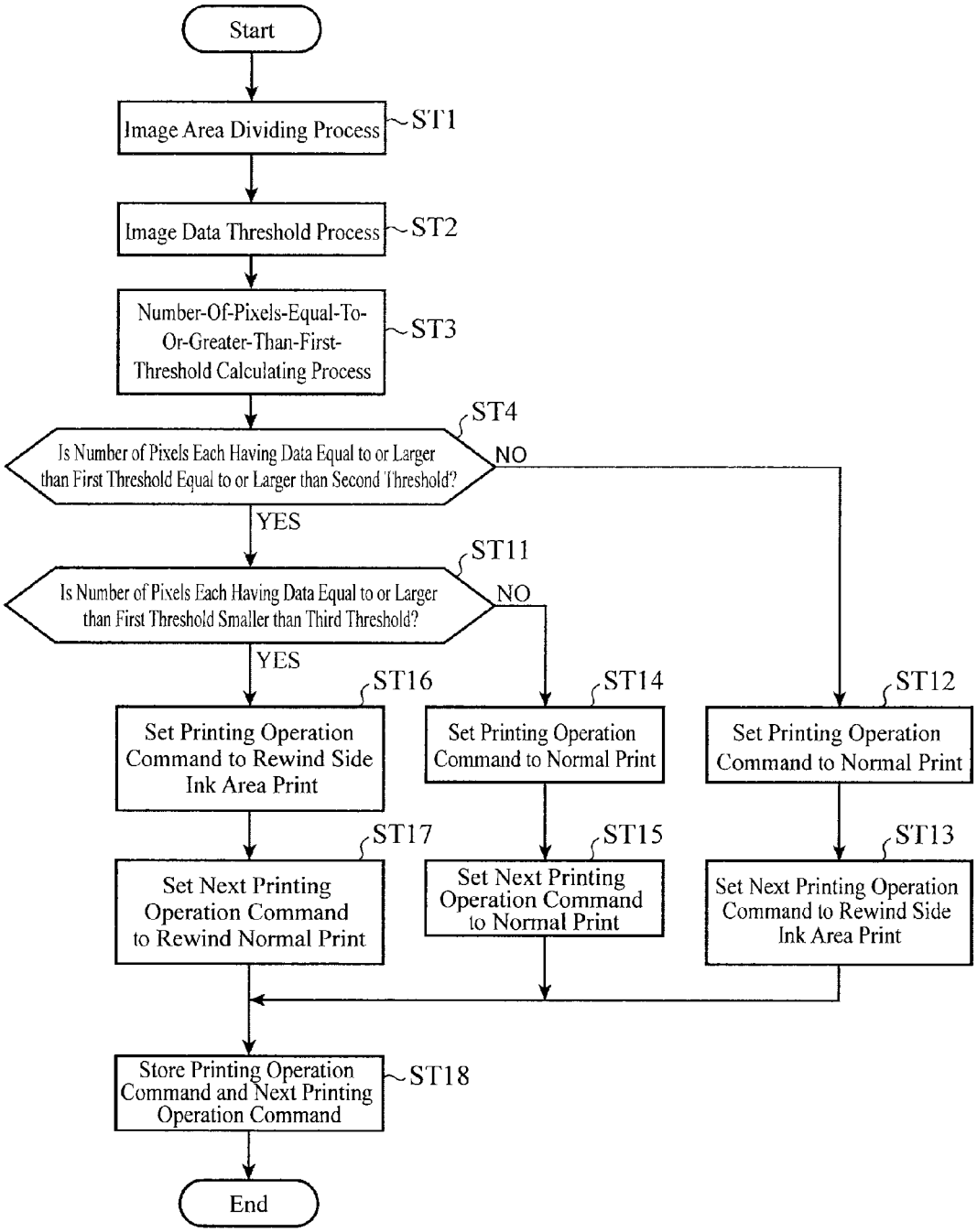
FIG. 10 is a flow chart showing a determining process of determining whether an ink sheet damage occurs in a print control device in accordance with Embodiment 3 of the present invention.

Next, a method of determining the degree of damage which the ink sheet will receive in accordance with this Embodiment 3 will be explained. FIG. 10 is a flow chart showing a determining process on inputted image data for the last odd-numbered print of the current print order, which is carried out by the ink sheet damage determining unit 10 in accordance with this Embodiment 3. This process is carried out before a print of the last odd-numbered screen of the current print order is produced. First, an image area dividing unit 10*a* divides the last odd-numbered image data of the current print order into image data about a predetermined number of areas in an image area dividing process ST1 (step ST1). In this embodiment, the image area of the inputted image data is divided into four areas (areas a1, a2, a3, and a4), as shown in FIG. 5, like in the case of Embodiment 1, and these areas a1, a2, a3, and a4 are sorted in descending order of the influence exerted upon the print image quality of the 2nd of two prints as follows:

$$a1=a2>a3>a4$$

Further, first thresholds Th11, Th12, Th13, and Th14, second thresholds Th21, Th22, Th23, and Th24, and third thresholds Th31, Th32, Th33, and Th34 are set to the areas a1, a2, a3, and a4, respectively. A relationship between the second threshold and the third threshold for each area is set up in such a way that the third threshold is large rather than the second threshold. That is, the following relationships: Th21<Th31, Th22<Th32, Th23<Th33, and Th24<Th34 are established. These thresholds are determined according to conditions including the type of the ink sheet and a grayscale table for determining the energy applied from a thermal head 5 to the ink sheet, and can be predetermined from the results of carrying out an experiment on each of the conditions. After that, in an image data threshold process (step ST2) carried out by the ink sheet damage calculating unit 10*b*, the ink sheet damage calculating unit carries out the threshold process by using the first threshold, like that in accordance with Embodiment 1. A number-of-pixels-equal-to-or-greater-than-first-threshold calculating process (step ST3) is the same as that in accordance with Embodiment 1. In an ink sheet damage determining process (step ST4), the ink sheet damage calculating unit compares the number of pixels each having image data equal to or larger than the first threshold in each area, which is determined in the number-of-pixels-equal-to-or-greater-than-first-threshold calculating process (step ST3), with the second threshold. The descriptions of the ink sheet damage determining process (step ST4) are the same as those in accordance with Embodiment 1.

Next, the operation of the printing operation selecting unit 10*c* will be explained. The printing operation selecting unit 10*c* in accordance with this Embodiment 3 determines ink screen areas used for both the last odd-numbered print of the current print order and ink screen areas used for the first screen print of the next print order. When the results of comparisons carried out in the ink sheet damage determining process (step ST4) show that the number of pixels is smaller than the second threshold in all the comparison cases, the printing operation selecting unit determines that the degree of damage which the ink sheet will receive is small and no influence of ink sheet damage is exerted upon the next screen print, and, in a printing operation command determining process (step ST12), the printing operation selecting unit determines that the last printing operation command of the current print order is a "normal print" to cause the print control device to use take-up side ink areas Y1, M1, C1, and OP1. Further, in a next printing operation command determining process (step ST13), the printing operation selecting unit determines that the first printing operation command of the next order is a "rewind supply side ink area print" to cause the print control device to rewind the ink sheet and use rewind side ink areas Y2, M2, C2, and OP2 which are yet-to-be-used areas of the ink screen which has been used last time for the previous print order to produce the first print of the next print order. Then, the last printing operation command of the current print order and the first printing operation command of the next print order, which are determined as above, are stored in a printing operation selecting unit 10*c* in a printing operation command/next printing operation command storing process (step ST18).

In contrast, when the results of the comparisons carried out in the ink sheet damage determining process (step ST4) show that the number of pixels is equal to or larger than the second threshold in at least one of all the comparison cases, in a second ink sheet damage determining process (step ST11), the printing operation selecting unit compares the number of pixels for each area of each color equal to or larger than the first threshold, which is determined in the number-of-pixels-equal-to-or-greater-than-first-threshold calculating process (step ST3), with the third threshold. More specifically, the printing operation selecting unit compares each of the numbers of pixels Sa1Y, Sa1M, and Sa1C, each pixel having a value equal to or larger than the first threshold in the area a1, with the third threshold Th31, compares each of the numbers of pixels Sa2Y, Sa2M, and Sa2C, each pixel having a value equal to or larger than the first threshold in the area a2, with the third threshold Th32, compares each of the numbers of pixels Sa3Y, Sa3M, and Sa3C, each pixel having a value equal to or larger than the first threshold in the area a3, with the third threshold Th33, and compares each of the numbers of pixels Sa4Y, Sa4M, and Sa4C, each pixel having a value equal to or larger than the first threshold in the area a4, with the third threshold Th34. Then, when the results of the comparisons show that the number of pixels is equal to or larger than the third threshold in at least one of all the comparison cases, the printing operation selecting unit determines that the degree of damage which the ink sheet will receive is large and the influence of the ink sheet damage on the next screen print is large, in a printing operation command determining process (step ST14), the printing operation selecting unit determines that the last printing operation command of the current print order is a "normal print" to cause the print control device to use the take-up side ink areas Y1, M1, C1, and OP1 to produce the last print of the current print order. Further, in a next printing operation command determining process (step ST15), the printing operation selecting unit determines that the first printing operation command of the next order is a "normal print" to cause the print control device to use take-up side ink areas Y1, M1, C1, and OP1 in the next ink screen to produce the first print of the next print order. Then, the last printing operation command of the current print order and the first printing operation command of the next print order, which are determined as above, are stored in the printing operation selecting unit 10*c* in the printing operation command/next printing operation command storing process (step ST18).

Further, when determining that the number of pixels is smaller than the third threshold in all the comparison cases in the second ink sheet damage determining process (step ST11), the printing operation selecting unit determines that the degree of damage which the ink sheet will receive is "medium", and it is preferable that the last print of the current print order is produced by using ink areas having a small influence on the printing of the 2nd of two screens, and, in the printing operation command determining process (step ST16), determines the last printing operation command of the current print order is a "rewind side ink area print" to cause the print control device to use the rewind side ink areas Y2, M2, C2, and OP2. Further, in the next printing operation command determining process (step ST17), the printing operation selecting unit determines that the first printing operation command of the next order is a "rewind normal print" to cause the print control device to use the take-up side ink areas Y1, M1, C1, and OP1 which are yet-to-be-used ink areas in the ink screen which has been used last time for the previous print order to produce the first print of the next print order. Then, the last printing operation command of the current print order and the first printing operation command of the next print order, which are determined as above, are stored in the printing operation selecting unit 10*c* in the printing operation command/next printing operation command storing process (step ST18).

In accordance with Embodiment 3, the image data are divided into areas in each of which the ink sheet easily receives damage, the degree of damage which the ink sheet will receive is classified into the following three degrees: "large", "medium", and "large" for each of the divided areas, and, when the degree of damage which the ink sheet will receive is small, the take-up side ink areas Y1, M1, C1, and OP1 are set to be used to produce the last print of the current print order, and the ink sheet is rewound and the rewind side ink areas Y2, M2, C2, and OP2 which are yet-to-be-used areas of the ink screen which has been used last time for the previous print order are set to be used to produce the first print of the next print order. Further, when the degree of damage which the ink sheet will receive is medium, it is determined that it is preferable that the last print of the current print order is produced by using ink areas having a small influence on the printing of the 2nd of two screens, and the take-up side ink areas Y2, M2, C2, and OP2 are set to be used to produce the last print of the current print order and the take-up side ink areas Y1, M1, C1, and OP1 which are yet-to-be-used ink areas in the ink screen which has been used last time for the previous print order are set to be used to produce the first print of the next print order. In addition, when the degree of damage which the ink sheet will receive is large, the take-up side ink areas Y1, M1, C1, and OP1 are set to be used to produce the last print of the current print order and the take-up side ink areas Y1, M1, C1, and OP1 in the next ink screen are set to be used to produce the first print of the next print order. As a result, the print control device can determine the degree of damage which the ink sheet will receive with a high degree of accuracy, and can utilize yet-to-be-used areas of the ink screen effectively without causing image quality defects due to ink wrinkles.

As previously explained, in accordance with Embodiment 3, because there is provided a print control device for use in a thermal transfer printer that puts an ink sheet and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, the print control device including: an image area dividing unit for dividing an image to be printed into a plurality of areas; an ink sheet damage calculating unit for comparing image element density data of each of the areas with a first threshold set correspondingly to the area to calculate the total number of pixels each having density data equal to or larger than the first threshold for each of the areas, and for comparing the total number of pixels calculated for the area with a second threshold set correspondingly to the area and with a third threshold larger than the second threshold; and a printing operation selecting unit for, when the plurality of areas include an area in which the calculated total number of pixels is equal to or larger than the second threshold and is smaller than the third threshold, carrying out a control operation of forming a print image by using an ink area on a rear side of the conveyance direction in a unit area having the predetermined size and forming a next print image by using an ink area on a front side of the conveyance direction in the unit area having the predetermined size, when the calculated total number of pixels is smaller than the second threshold in every one of the plurality of areas, carrying out a control operation of forming a print image by using an ink area on a front side of the conveyance direction in the unit area having the predetermined size and forming a next print image by using an ink area on a rear side of the conveyance direction in the unit area having the predetermined size, and, when the calculated total number of pixels is equal to or larger than the third threshold in either one of the plurality of areas, carrying out a control operation of forming a print image by using an ink area on a front side of the conveyance direction in the unit area having the predetermined size and forming a next print image by using an ink area in a new unit area, the number of wrinkles which occur in the ink sheet and the degree of damage which occurs in the ink sheet can be reduced and prints having high print quality can be acquired, while the use efficiency of the ink sheet can be improved.

Embodiment 4.

The example of determining the degree of damage which the ink sheet will receive from the color image data about Y, M, and C colors is shown in each embodiment mentioned above. In Embodiment 4, an example in which a gloss mode and a matt mode are included in a transfer mode of OP will be explained.

The gloss mode is the one in which the energy applied to a thermal head is applied uniformly to a print surface to transfer an OP ink to the print surface, so that a print having a glossy surface condition is acquired. Generally, the applied energy and the degree of damage which an ink sheet will receive in the gloss mode are less than those in a case in which Y, M, and C ink colors are transferred with a larger number of levels of gray scale (high concentration). In contrast, the matt mode is the one in which the energy applied to the thermal head is changed to transfer the OP ink to the print surface and then form asperities on the print surface to which the OP ink has been transferred, so that a print having a matt surface condition is acquired. Generally, the degree of damage which the ink sheet will receive is larger than that in the gloss mode. This OP transfer mode is specified according to the user's liking through a not shown transfer mode selecting function disposed in either an image input device that inputs image data to a printer 1, such as a computer, or the printer 1.

In this embodiment, an example in which in a case of placing a print order to print two L size screens from ink areas each having a single 2L size screen which is provided as a unit area having a predetermined size by using an ink sheet for 2L size, the print order has an odd number of prints and is the one to print a last odd-numbered screen of the print order by using an area on an ink sheet take-up side of the ink sheet for 2L size, and print a first L size screen of a next print order will be explained, like in the case of Embodiment 1.

Figure 11:
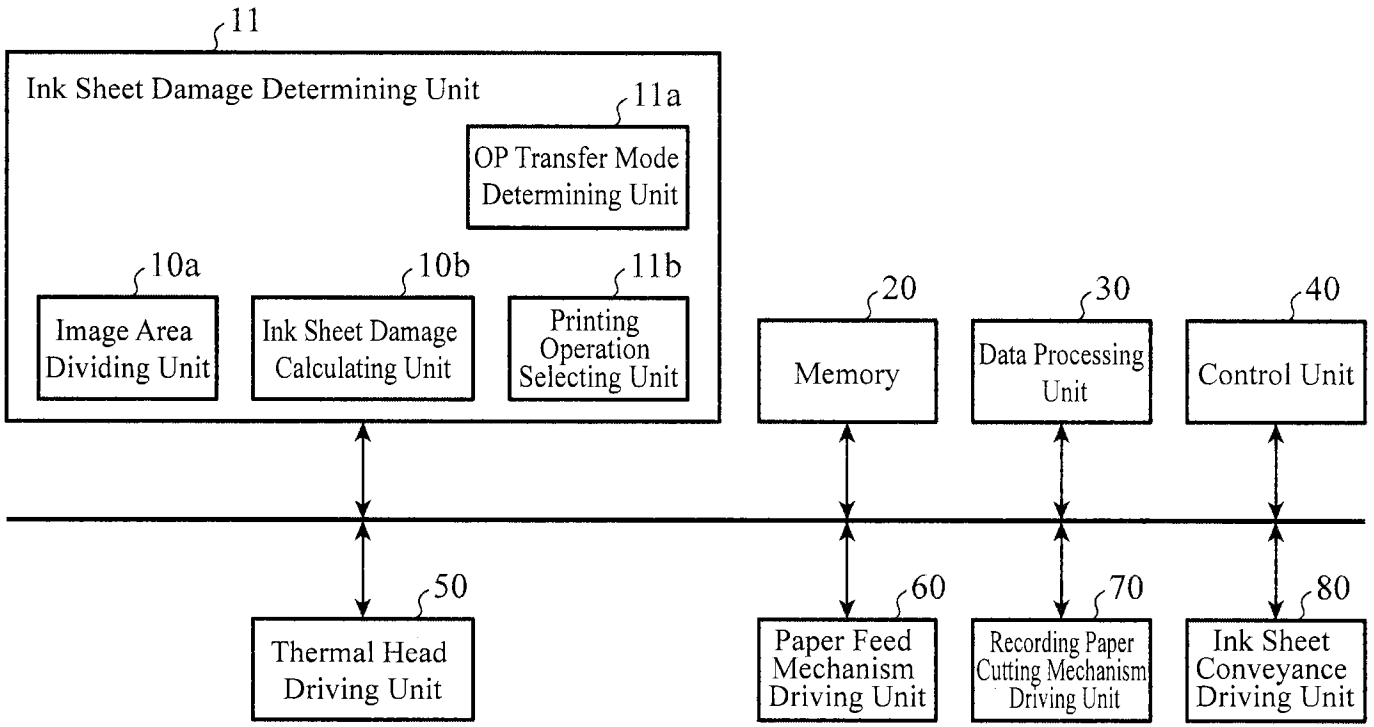
FIG. 11 is a block diagram showing the system structure of a print control device in accordance with Embodiment 4 of the present invention.

FIG. 11 is a block diagram showing the system structure of a thermal transfer printer in accordance with Embodiment 4 of the present invention. An ink sheet damage determining unit 11 has an OP transfer mode determining unit 11*a* for determining whether the OP transfer mode is the gloss mode or the matt mode. Further, when the OP transfer mode determining unit 11*a* determines that the OP transfer mode is the gloss mode and the total number of pixels calculated for every one of all areas is smaller than a second threshold, a printing operation selecting unit 11*b* performs a control operation of using a remaining area of an already-used ink area in a unit area having a predetermined size for formation of the next print image, whereas when the OP transfer mode determining unit 11*a* determines that the OP transfer mode is the matt mode and the plurality of areas include an area in which the total number of pixels calculated is equal to or larger than the second threshold, the printing operation selecting unit 11*b* performs a control operation of forming the next print image by using an ink area in a new unit area. Because the other components including an image area dividing unit 10*a* and an ink sheet damage calculating unit 10*b* are the same as those in accordance with Embodiment 1, the other components are designated by the same reference numerals and the explanation of the other components will be omitted hereafter.

Figure 12:
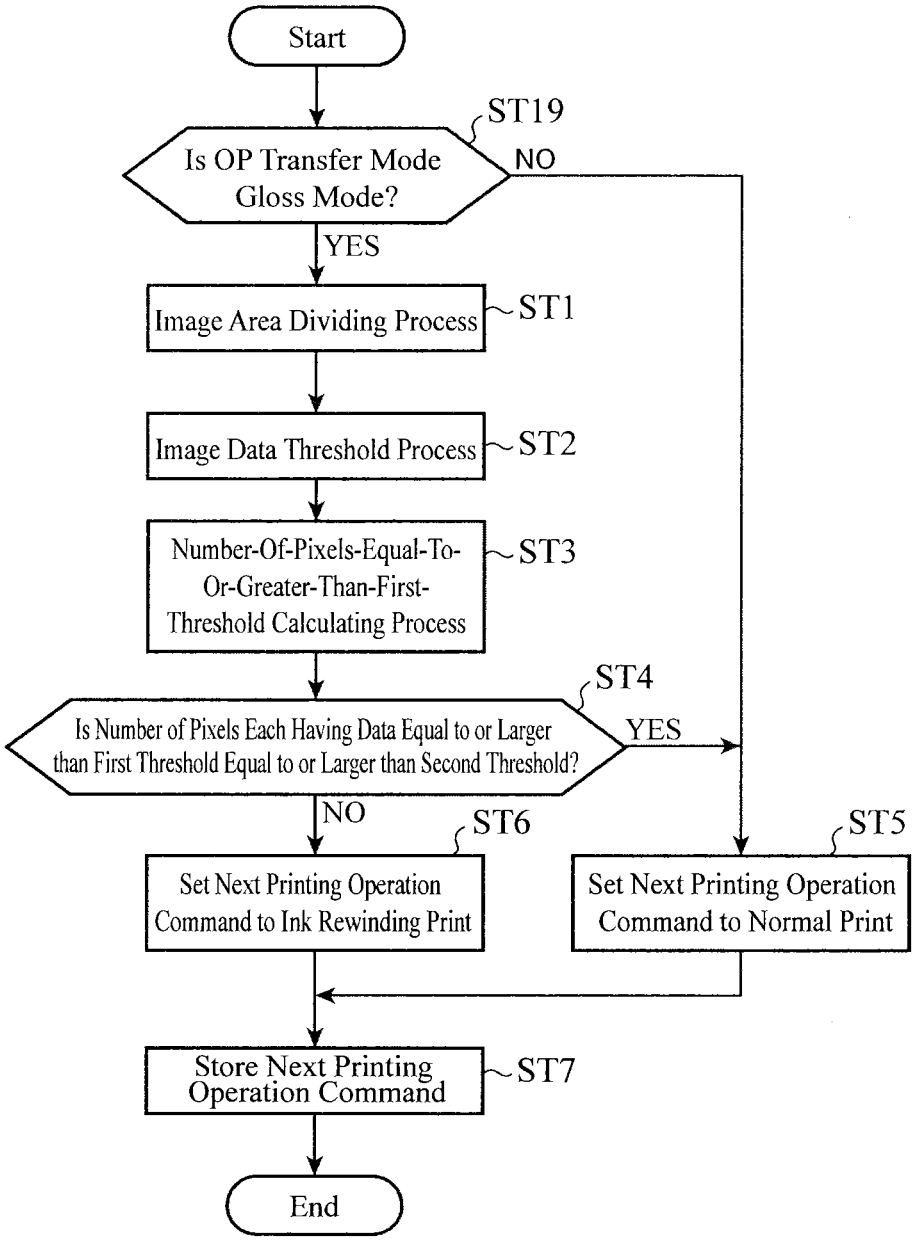
FIG. 12 is a flow chart showing a determining process of determining whether an ink sheet damage occurs in the print control device in accordance with Embodiment 4 of the present invention.

Next, a method of determining the degree of damage which the ink sheet will receive in accordance with this Embodiment 4 will be explained. FIG. 12 is a flow chart showing a determining process on inputted image data for the last odd-numbered print of the current print order, which is carried out by the ink sheet damage determining unit 10 in accordance with this Embodiment 4. First, the OP transfer mode determining unit 11*a* determines the OP transfer mode in an OP transfer mode determining process (step ST19). When the OP transfer mode is the non-gloss mode, i.e., the matt mode, the printing operation selecting unit 11*b* determines that the first printing operation command of the next print order is a "normal print" in a next printing operation command process (step ST5). In contrast, when, in step ST19, the OP transfer mode is the gloss mode, the printing operation selecting unit carries out the same ink sheet damage determining process as that shown in Embodiment 1. More specifically, the thermal transfer printer carries out processes including from an image area dividing process (step ST1) to a next printing operation command determining process (step ST6). This printing operation command which is determined in this way is stored in a printing operation selecting unit 11*b* in a next printing operation command storing process (step ST7) until the next print order is inputted to the printer.

Thus, the thermal transfer printer in accordance with Embodiment 4 carries out the determining process of determining the OP transfer mode, thereby making it possible to determine the degree of damage which the ink sheet will receive with a higher degree of accuracy.

Further, in Embodiment 4, although the case in which the print order has an odd number of prints and is the one to print the last odd-numbered screen of the print order by using an area on an ink sheet take-up side of the ink sheet for 2L size, and the first L size screen of the next print order is then printed is explained above, when the OP transfer mode is the matt mode and ink areas used for the printing of the last odd-numbered screen of the print order are selected, like in the case of Embodiment 2, a rewind side ink area OP2 is used for an OP transfer of the last odd-numbered screen of the print order regardless of the degree of damage which each of the color ink sheets Y, M, and C will receive, and a take-up side ink area OP1 of the previous ink screen is used for an OP transfer of the first screen of the next print order. As a result, OP transfers which are not affected by the influence of the damage which the OP ink sheet receives can be carried out, and the use efficiency of the ink sheet can be improved.

As previously explained, in accordance with Embodiment 4, because there is provided a print control device for use in a thermal transfer printer that puts an ink sheet and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, and that forms an overcoat layer for protecting a printed image, the print control device including: an image area dividing unit for dividing an image to be printed into a plurality of areas; an ink sheet damage calculating unit for comparing image element density data of each of the areas with a first threshold set correspondingly to the area to calculate the total number of pixels each having density data equal to or larger than the first threshold for each of the areas, and for comparing the total number of pixels calculated for the area with a second threshold set correspondingly to the area; an OP transfer mode determining unit for determining whether a transfer mode of the overcoat layer is a gloss mode in which a transfer surface is a glossy surface, or a matt mode in which the transfer surface is a matt surface; and a printing operation selecting unit for, when the OP transfer mode determining unit determines that the transfer mode is the gloss mode and the calculated total number of pixels is smaller than the second threshold in every one of all the areas, carrying out a control operation of using a remaining area of an already-used ink area in a unit area having the predetermined size for formation of a next print image, and, when the OP transfer mode determining unit determines that the transfer mode is the matt mode or the plurality of areas include an area in which the calculated total number of pixels is equal to or larger than the second threshold, carrying out a control operation of forming a next print image by using an ink area in a new unit area, the number of wrinkles which occur in the ink sheet and the degree of damage which occurs in the ink sheet can be reduced and prints having high print quality can be acquired, while OP transfers which are not affected by the influence of the damage of the OP ink seat can be carried out and the use efficiency of the ink sheet can be improved.

Further, in accordance with Embodiment 4, because there is provided a print control device for use in a thermal transfer printer that puts an ink sheet having an overcoat area and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, and that forms an overcoat layer for protecting a printed image by transferring the overcoat area to the recording paper, the print control device including: an OP transfer mode determining unit for determining whether a transfer mode of the overcoat layer is a gloss mode in which a transfer surface is a glossy surface, or a matt mode in which the transfer surface is a matt surface; and a printing operation selecting unit for, when the OP transfer mode determining unit determines that the transfer mode is the gloss mode, carrying out a control operation of using an overcoat area on a front side of the conveyance direction in a unit area having the predetermined size for formation of the overcoat layer, and, when the OP transfer mode determining unit determines that the transfer mode is the matt mode, carrying out a control operation of using an overcoat area on a rear side of the conveyance direction in the unit area having the predetermined size for formation of the overcoat layer, OP transfers which are not affected by the influence of the damage of the OP ink seat can be carried out and the use efficiency of the ink sheet can be improved.

Embodiment 5.

In each of the above-mentioned embodiments, the example of using the results of dividing an image area to be printed into a plurality of areas and determining the degree of damage which the ink sheet will receive for each of the areas with a high degree of accuracy to select ink areas which are used for the first print of the next print order or ink areas which are used for the last odd-numbered screen print of the current print order is shown. In contrast with this, in Embodiment 5, an example of fixing ink areas to be used and converting image data by using the results of the determination of the degree of damage which an ink sheet will receive will be explained.

Figure 13:
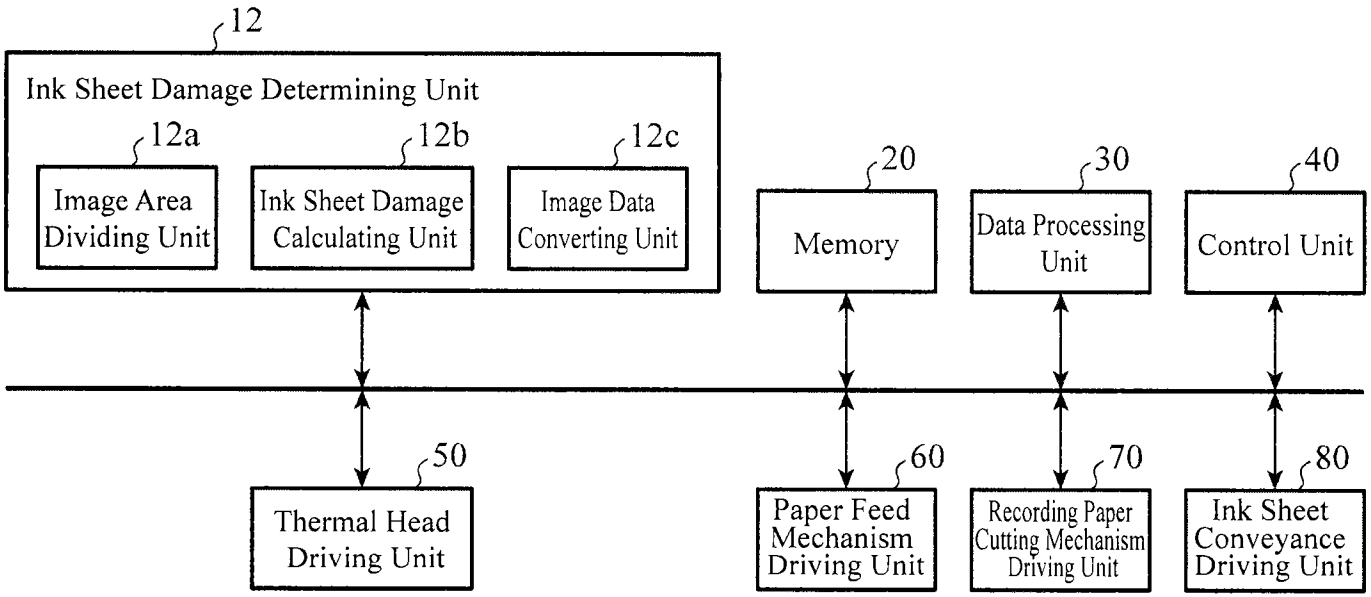
FIG. 13 is a block diagram showing the system structure of a print control device in accordance with Embodiment 5 of the present invention.

Because a thermal transfer printer in accordance with this Embodiment 5 has the same mechanism structure as that in accordance with Embodiment 1, the explanation of the mechanism structure will be omitted hereafter. FIG. 13 is a block diagram showing the system structure of the thermal transfer printer in accordance with this Embodiment 5. An ink sheet damage determining unit 12 includes: an image area dividing unit 12*a* for dividing image data read into a memory 20 into image data about an area on a front side of a direction of conveyance of the ink sheet 3 and image data about an area on a rear side of the direction of conveyance of the ink sheet 3; an ink sheet damage calculating unit 12*b* for comparing image element density data about each of the areas into which the inputted image is divided with a first threshold set correspondingly to the area to calculate the total number of pixels each having density data equal to or larger than the first threshold for each of the areas, and for comparing the total number of pixels calculated for each of these areas with a second threshold set correspondingly to the area; and an image data converting unit 12*c* for performing a control operation of flipping a print image by 180 degrees to print this print image when the total number of pixels of the area on a front side of the direction of conveyance of the ink sheet is smaller than the second threshold set for the area and the total number of pixels of the area on a rear side of the direction of conveyance of the ink sheet is equal to or larger than the second threshold set for the area. The other components of the thermal transfer printer are the same as those in accordance with Embodiment 1.

Figure 14:
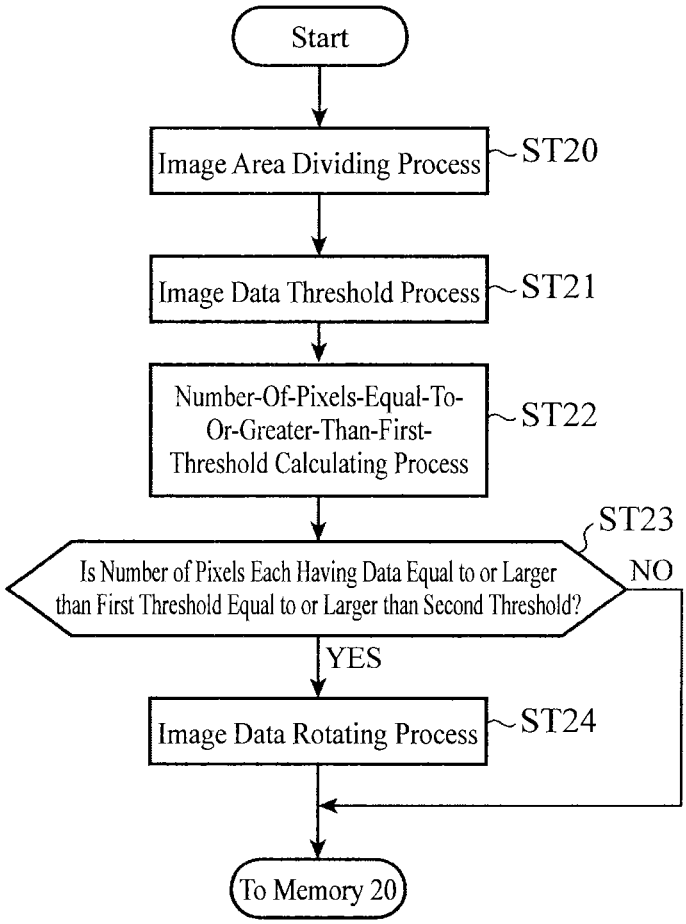
FIG. 14 is an explanatory drawing showing an example of a division of an image area and an example of conversion of image data in the print control device in accordance with Embodiment 5 of the present invention.
Figure 15:
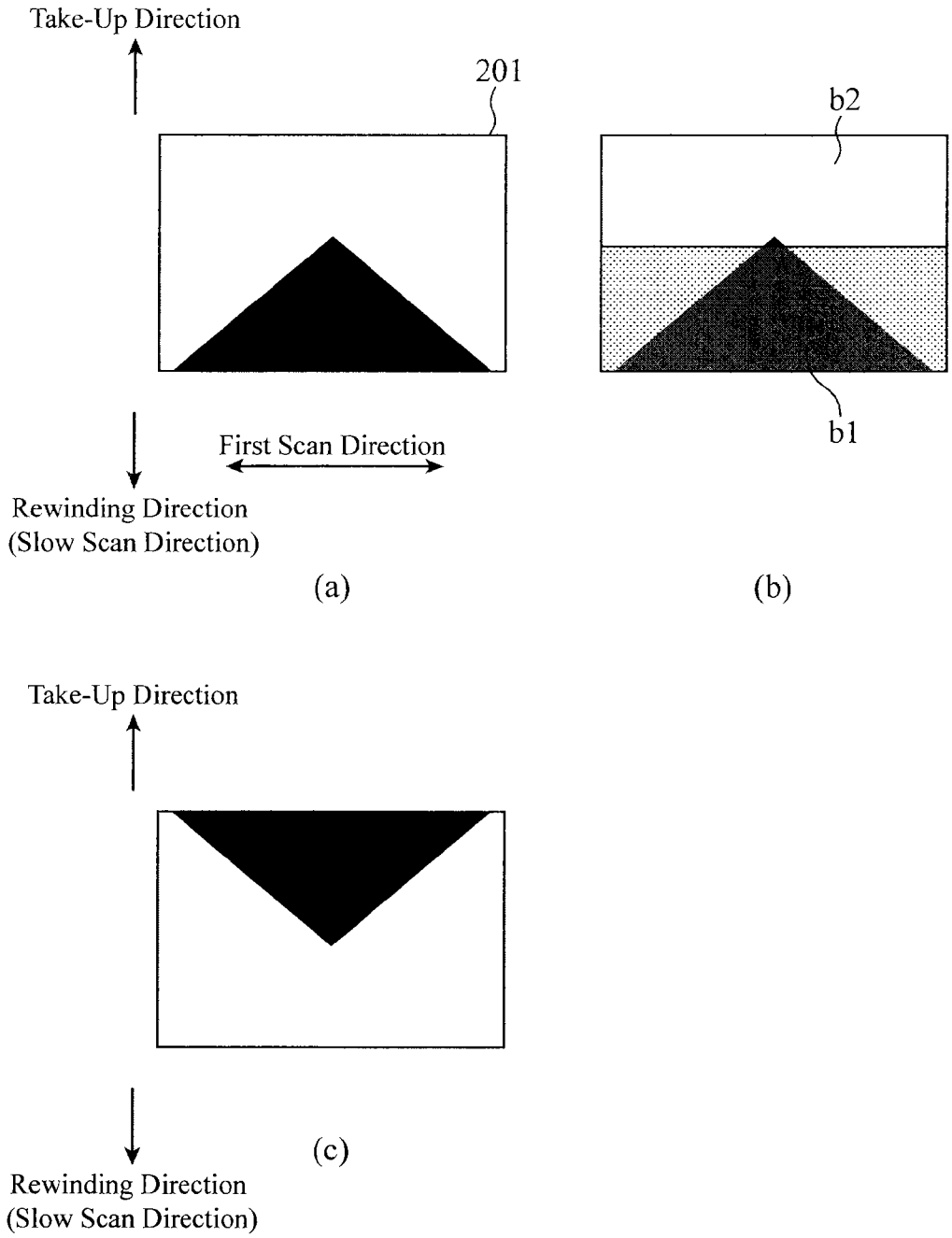
FIG. 15 is an explanatory drawing showing an example of source image data, an example of a division of an image area, and converted image data in the print control device in accordance with Embodiment 5 of the present invention.

Next, a determining process of determining the image data and a converting process of converting the image data in accordance with Embodiment 5 will be explained. In Embodiment 5, a case of dividing the image area into two areas will be explained. FIG. 14 is a flow chart showing the determining process of determining the inputted image data about the 1st of two prints which is carried out by the ink sheet damage determining unit 12 in accordance with Embodiment 5, and FIG. 15 is a diagram showing an example of the image data which is the target for the determination. FIG. 15(*a*) is a diagram showing yet-to-be-converted source data, FIG. 15(*b*) is a diagram showing an image area division state, and FIG. 15(*c*) is a diagram showing converted image data.

The image area dividing unit 12*a* divides the inputted image data into image data about a predetermined number of areas in an image area dividing process (step ST20). According to this embodiment, the image area dividing unit 12*a* divides the image area 201 of the inputted image data shown in FIG. 15(*a*) into two areas b1 and b2. Because the image area b1 corresponds to a position on a side of an ink sheet rewinding direction, and the distance between the image area and an ink sheet print area 102*b* of the 2nd of the two prints shown in FIG. 18 with respect to a slow scan direction is short, there is a possibility that the print image quality of the 2nd of the two prints gets worse when a large degree of damage and wrinkles occur in an ink sheet area corresponding to the position of the image area b1. On the other hand, because the distance between the image area b2 corresponding to a position on an ink sheet take-up side and an ink margin S with respect to a first scan direction is long, and the distance between the image area b2 and the ink sheet print area 102*b* of the 2nd of the two prints with respect to the slow scan direction is also long, there is a low possibility that even if the ink sheet receives a certain degree of damage in the image area b2, the damage has an influence on the print image quality of the 2nd of the two prints. These areas b1 and b2 are sorted in descending order of the influence exerted upon the print image quality of the 2nd of the two prints as follows:

b1>b2

Further, first thresholds Th1*b*1 and Th1*b*2 and second thresholds Th2*b*1 and Th2*b*2 are set for the area b1 and b2, respectively.

Next, the operation of the ink sheet damage calculating unit 12*b* will be explained. The ink sheet damage calculating unit 12*b* calculates the degree of damage which the ink sheet will receive quantitatively. In an image data threshold process (step ST21), the ink sheet damage calculating unit 12*b* compares the image element data in each of the divided image areas with the first threshold set to the divided area to carry out a binarization process. The ink sheet damage calculating unit compares the image element data in the area b1 with the threshold Th1*b*1 and also compares the image element data in the area b2 with the threshold Th1*b*2 to carry out a binarization process. For example, the ink sheet damage calculating unit processes all the pixels in each area in such a way as to set each pixel having a value equal to or larger than the first threshold to "255" and also set each pixel to having a value smaller than the first threshold "0." The ink sheet damage calculating unit carries out these processes on Y data, M data, and C data of each area.

Next, the ink sheet damage calculating unit 12*b* calculates the total number of pixels each having a value equal to or larger than the first threshold for each of Y, M, and C data on which the binarization process has been carried out in the image data threshold process of step ST21 in a number-of-pixels-equal-to-or-greater-than-first-threshold calculating process (step ST22). Hereafter, the numbers of pixels each having a value equal to or larger than the first threshold for Y, M, and C colors in the area b1 are expressed as Sb1Y, Sb1M, and Sb1C, respectively, and the numbers of pixels each having a value equal to or larger than the first threshold for the Y, M, and C colors in the area b2 are expressed as Sb2Y, Sb2M, and Sb2C, respectively.

After completing the number-of-pixels-equal-to-or-greater-than-first-threshold calculating process (step ST22), the ink sheet damage calculating unit 12*b* compares the number of pixels each having a value equal to or larger than the first threshold in each area, which is determined in the number-of-pixels-equal-to-or-greater-than-first-threshold calculating process (step ST22), with the second threshold in a determining process of determining a last odd-numbered image of a current print order (step ST23). More specifically, the ink sheet damage calculating unit compares each of the numbers of pixels Sb1Y, Sb1M, and Sb1C in the area b1, each pixel having a value equal to or larger than the first threshold, with the second threshold Th2*b*1, and also compares each of the numbers of pixels Sb2Y, Sb2M, and Sb2C in the area b2, each pixel having a value equal to or larger than the first threshold, with the second threshold Th2*b*2.

Next, the operation of the image data converting unit 12*c* will be explained. The image data converting unit 12*c* carries out the conversion process on the last odd-numbered image of the current print order. When the result of at least one of the comparison cases, in step ST23, shows that the number of pixels Sb1Y, Sb1M, or Sb1C in the area b1, each pixel having a value equal to or larger than the first threshold, is equal to or larger than the second threshold Th2*b*1, and every one of the numbers of pixels Sb2Y, Sb2M, and Sb2C in the area b2 is smaller than the second threshold Th2*b*2, the image data converting unit determines that the degree of damage which the ink sheet will receive in the area b1 is large while the degree of damage which the ink sheet will receive in the area b2 is small, and, in an image data rotating process (step ST24), rotates the last odd-numbered image data of the current print order by 180 degrees, as shown in FIG. 15(*c*), and sends the image data on which the rotating process has been carried out to the memory 20. In contrast, when the results of all the comparison cases show that the number of pixels is smaller than the second threshold, the image data are sent to the memory 20 without being converted.

The image data stored in the memory 20 are converted into data for printing by a data processing unit 30. A control unit 40 then controls a thermal head driving unit 50, a paper feed mechanism driving unit 60, a recording paper cutting mechanism driving unit 70, and an ink sheet conveyance driving unit 80, and carries out a printing operation. The print control device carries out subsequent operations in the same way as that in accordance with Embodiment 1, and, when producing the last print (odd-numbered print) of the current print order, the print control device carries out a printing operation using take-up side ink areas Y1, M1, C1, and OP1. Then, when producing a first screen print of a next print order, the print control device carries out a printing operation using rewind side ink areas Y2, M2, C2, and OP2 which are yet-to-be-used areas of a previous ink screen by carrying out the same operation as that shown in Embodiment 1 in the case in which the printing operation command is an "ink rewinding print."

Thus, in accordance with Embodiment 5, image data are divided into image data about a rewind side ink area which easily exerts an influence upon the image quality of the 2nd of two screens, and image data about a take-up side ink area which does not easily exert an influence upon the image quality of the 2nd of the two screens, the degree of damage which the ink sheet will receive is determined for each divided area, and, when it is determined that the degree of damage which the ink sheet will receive in the rewind side ink area is large while the degree of damage which the ink sheet will receive in the take-up side ink area is small, the image of the 1st of the two screens is rotated by 180 degrees and is printed onto the ink take-up side screen area. As a result, the influence of the ink sheet damage of the 1st of the two screens on the print image quality to the next 2nd of the two screens can be reduced.

In Embodiment 5, when the image is rotated by 180 degrees, the image printed on the recording paper 2 is ejected from the printer 1 in a state in which the image is rotated, and therefore the direction of the image is inverse to those of the other print results. Therefore, a unit for notifying the user that the direction of the image is inverse to those of the other print results by way of a not shown computer or the like can be disposed.

As previously explained, in accordance with Embodiment 5, because there is provided a print control device for use in a thermal transfer printer that puts an ink sheet and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, the print control device including: an image area dividing unit for dividing an image to be printed into an area on a front side of a direction of conveyance of the ink sheet and an area on a rear side of the direction of conveyance of the ink sheet; an ink sheet damage calculating unit for comparing image element density data about each of the areas into which the inputted image is divided with a first threshold set correspondingly to the area to calculate the total number of pixels each having density data equal to or larger than the first threshold for the area, and for comparing the total number of pixels calculated for the area with a second threshold set correspondingly to the area; and an image data converting unit for carrying out a control operation of flipping the image to be printed by 180 degrees to print this image when the total number of pixels of the area on a front side of the direction of conveyance is smaller than the second threshold set for the area and the total number of pixels of the area on a rear side of the direction of conveyance is equal to or larger than the second threshold set for the area, the number of wrinkles which occur in the ink sheet and the degree of damage which occurs in the ink sheet can be reduced and prints having high print quality can be acquired, while the use efficiency of the ink sheet can be improved.

Embodiment 6.

The example of determining the degree of damage which the ink sheet will receive on the basis of the image data is shown in each of the above-mentioned embodiments. In contrast with this, in Embodiment 6, an example of determining the degree of damage which an ink sheet will receive on the basis of the temperature of a thermal head 5 will be explained. In this embodiment, a case of selecting ink screen areas used for a first print of a next print order on the basis of the thermal head temperature which is detected after a print of each color is completed when a last odd-numbered screen of a current print order is printed by using take-up side ink areas Y1, M1, C1, and OP1 will be explained.

Figure 16:
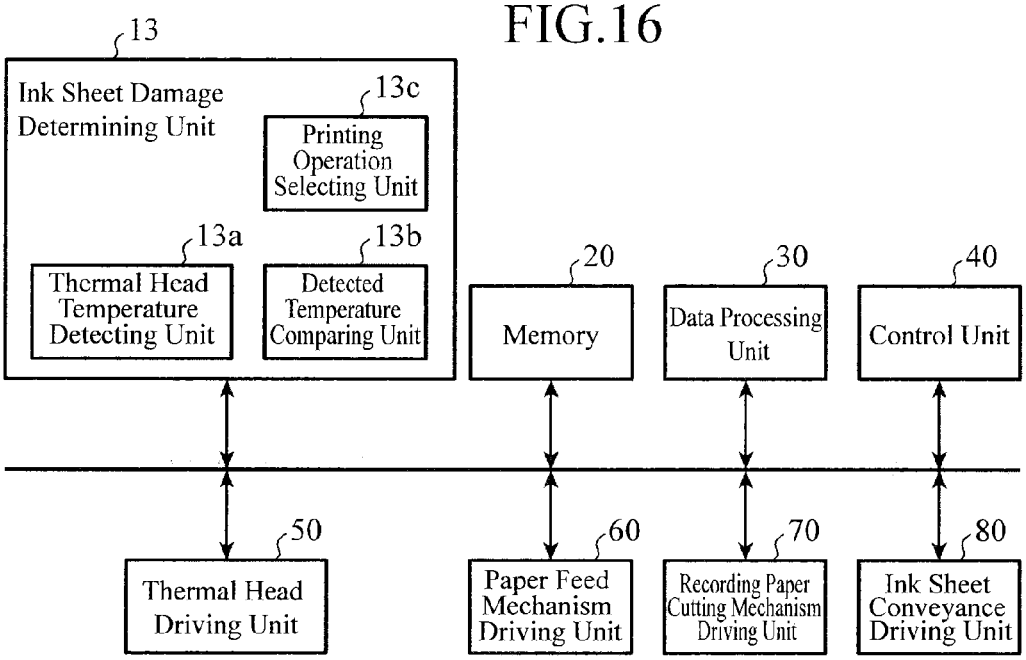
FIG. 16 is a block diagram showing the system structure of a print control device in accordance with Embodiment 6 of the present invention.

Because the mechanism structure of a thermal transfer printer in accordance with Embodiment 6 is the same as that in accordance with Embodiment 1, the explanation of the mechanism structure will be omitted hereafter. FIG. 16 is a block diagram showing the system structure of the thermal transfer printer in accordance with Embodiment 6. An ink sheet damage determining unit 13 in accordance with this embodiment includes a thermal head temperature detecting unit 13*a* for detecting the thermal head temperature every time when a print of each of Y, M, and C color screens is completed, a detected temperature comparing unit 13*b* for comparing the detected temperature with a preset threshold temperature, and a printing operation selecting unit 13*c* for performing a control operation of, when the thermal head temperature is equal to or higher than the predetermined threshold, using an ink area in a new unit area having a predetermined size to form a next print image, or, when the thermal head temperature is lower than the threshold, using a remaining area of an already-used ink area in a unit area having the predetermined size. The other components of the thermal transfer printer are the same as those in accordance with Embodiment 1.

Figure 17:
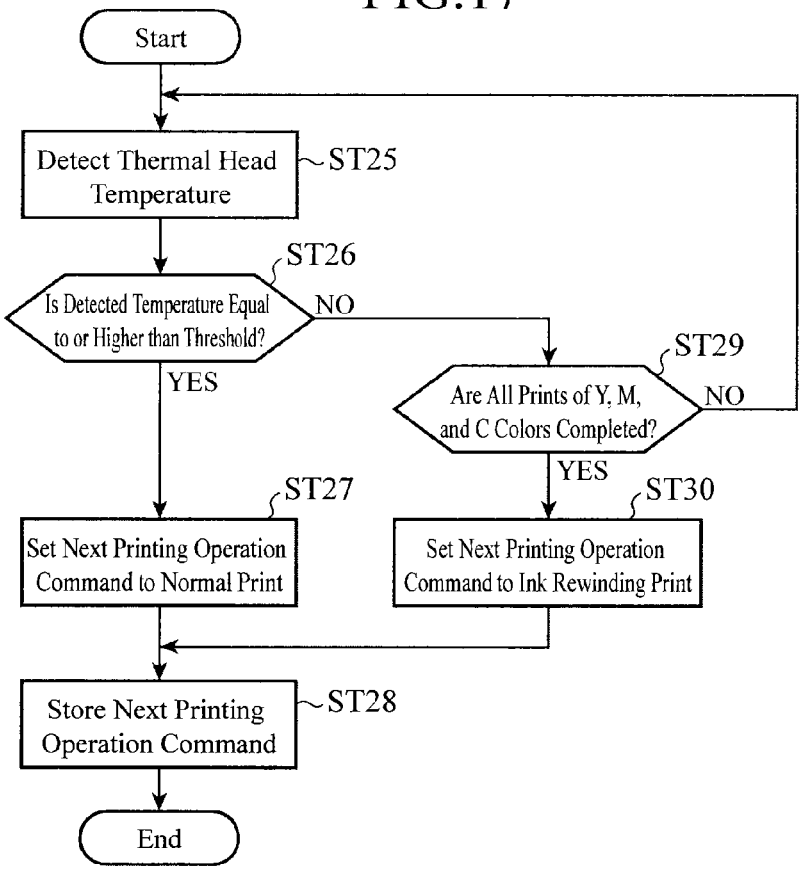
FIG. 17 is a flow chart showing a determining process of determining whether an ink sheet damage occurs in the print control device in accordance with Embodiment 6 of the present invention.

Next, a determining process of determining the degree of damage which the ink sheet will receive in accordance with Embodiment 6 will be explained. FIG. 17 is a flow chart showing the determining process of determining the degree of damage which the ink sheet will receive when printing the last odd-numbered screen of the current print order, the determining process being carried out by the ink sheet damage determining unit 13 in accordance with Embodiment 6. Immediately after a print of one screen of Y color is completed, the thermal head temperature detecting unit 13*a* detects the thermal head temperature first in a thermal head temperature detecting process (step ST25). More specifically, the thermal head temperature detecting unit converts an analog signal from a not shown thermistor mounted in the thermal head into a digital signal value by using a not shown A/D converter, and detects the converted value as the temperature.

The detection temperature comparing unit 13*b* then compares whether the detected temperature exceeds the preset threshold temperature in a detected temperature comparing process (step ST26). Then, when the detected temperature is equal to or higher than the threshold temperature, the printing operation selecting unit 13*c* determines that the degree of damage which the ink sheet will receive is large, and, in a next printing operation command determining process (step ST27) for determining an operation command for a print of the first single screen of the next order, sets the next printing operation command to a "normal print." This determined printing operation command is then stored until the next print order is inputted to the thermal transfer printer in a next printing operation command storing process (step ST28).

Further, when the detected temperature is lower than the threshold in step ST26, the printing operation selecting unit 13*c* determines that the degree of damage caused by the Y color print which the ink sheet will receive is small and then checks to see whether all prints of Y, M, and C colors have been completed in a color print completion checking process (step ST29). At this time, because prints of M and C colors are not completed, immediately after a next print of one screen of M color is completed, the thermal head temperature detecting unit detects the thermal head temperature again in the thermal head temperature detecting process (step ST25). When the detected temperature is equal to or higher than the threshold temperature, the printing operation selecting unit sets the next printing operation command to a "normal print" in the next printing operation command determining process (step ST27), like in the case of printing one screen of Y color, and this determined printing operation command is stored until the next print order is inputted to the thermal transfer printer in the next printing operation command storing process (step ST28). When the detected temperature is lower than the threshold, immediately after a next print of one screen of C color is completed, the thermal head temperature detecting unit detects the thermal head temperature in the thermal head temperature detecting process (step ST25), and the detected temperature comparing unit carries out the same temperature comparing process as those performed when printing the screens of Y and M colors. Then, when all the temperatures detected immediately after printing the screens of Y, M, and C colors are lower than the threshold temperature, the printing operation selecting unit sets the next printing operation command to an "ink rewinding print" in a next printing operation command determining process (step ST30), and this determined printing operation command is stored until the next print order is inputted to the thermal transfer printer in the next printing operation command storing process (step ST28).

The threshold temperature is determined according to conditions including the type of the ink sheet and a grayscale table for determining the energy applied from the thermal head to the ink sheet, and can be predetermined from the results of carrying out an experiment on each of the conditions.

Next, an operation of printing the first screen of the next print order will be explained. When the next printing operation command stored in the printing operation selecting unit 13*c* is a "normal print", the same printing operation as that in the case of a "normal print" shown in Embodiment 1 is carried out first. More specifically, a print of the first screen of the next print order is produced by using the take-up side ink areas Y1, M1, C1, and OP1 of an ink screen next to an ink screen used for a print of a last single screen of a previous print order.

When the next printing operation command stored in the printing operation selecting unit 13*c* is an "ink rewinding print", the same printing operation as that in the case of an "ink rewinding print" shown in Embodiment 1 is carried out. More specifically, a print of the first screen of the next print order is produced by using rewind side ink areas Y2, M2, C2, and OP2 which are yet-to-be-used areas of the ink screen used for the print of the last single screen of the previous print order.

Because the degree of damage which the ink sheet will receive is determined on the basis of the thermal head temperature which is detected after a print of a screen of each of Y, M, and C colors is completed, and ink screen areas used for a first print of the next print order are determined in Embodiment 6, as mentioned above, the determination of the degree of damage which the ink sheet will receive can be carried out in consideration of a history of the heat applied to the thermal head, and hence the degree of damage which the ink sheet will receive can be determined with a higher degree of accuracy and ink areas used for the first print of the next print order can be selected on the basis of the results of the determination. Therefore, the number of wrinkles which occur in the ink sheet and the degree of damage which occurs in the ink sheet can be reduced and prints having high print quality can be acquired, while the use efficiency of the ink sheet can be improved.

As mentioned above, in accordance with Embodiment 6, because there is provided a print control device for use in a thermal transfer printer that puts an ink sheet and a recording paper on top of each other, and, while conveying the ink sheet, drives a thermal head to produce a plurality of heat transfer prints of an image in units of a predetermined size, the plurality of heat transfer prints extending on the recording paper in a direction of the conveyance and the image having a size smaller than the predetermined size, the print control device including: a thermal head temperature detecting unit for detecting a temperature of the thermal head; a detected temperature comparing unit for determining whether or not the thermal head temperature detected by the thermal head temperature detecting unit is equal to or higher than a predetermined threshold; and a printing operation selecting unit for, when the thermal head temperature is equal to or higher than the predetermined threshold, carrying out a control operation of forming a next print image by using an ink area in a new unit area having the predetermined size, and for, when the thermal head temperature is lower than the threshold, carrying out a control operation of forming a next print image by using a remaining area of an already-used ink area in a unit area having the predetermined size, the number of wrinkles which occur in the ink sheet and the degree of damage which occurs in the ink sheet can be reduced and prints having high print quality can be acquired, while the use efficiency of the ink sheet can be improved.

Embodiment 7.

The example in which the print control device individually determines the degree of damage which the ink sheet will receive in each divided screen area is shown in each of above-mentioned Embodiments 1 to 4. In contrast with this, in Embodiment 7, an example in which a print control device determines the degree of damage which each divided screen area will receive by referring to the degree of damage which will occur in another area adjacent to the area which is the target for the determination of the damage will be explained. In this embodiment, like in the case shown in Embodiment 3, the print control device determines the degree of damage which an ink sheet will receive in each area which is the target for the determination of the damage on a triple scale of "large", "medium", and "small" by using first through third thresholds, and, when determining that the degree of damage is "medium," determines the degree of damage of another area adjacent to the target for the determination by using a fourth threshold, and finally determines the degree of damage of the area which is the target for the determination in consideration of the results of the damage determination performed on the other area adjacent to the above-mentioned target area for the determination. For example, when determining that the degree of damage which the ink sheet will receive in the area a1 in the example shown in FIG. 5 is "medium," the print control device determines the degree of damage which the ink sheet will receive in the area a3 adjacent to the area a1 and the degree of damage which the ink sheet will receive in the area a4 adjacent to the area a1 by using the fourth thresholds set to the areas a3 and a4, respectively, and then determines the degree of damage which the ink sheet will receive in the area a1 in consideration of the results of the determination. Further, in this embodiment, a case in which the ink areas used for a print of a last odd-numbered screen of a current print order are either take-up side ink areas Y1, M1, C1, OP1 or rewind side ink areas Y2 and M2, C2, and OP2, the determination of the degree of damage which the ink sheet will receive is carried out by using the image data about the last odd-numbered screen of the current print order, and ink areas used for a first print of a next print order are determined from the results of the above-mentioned ink sheet damage determination will be explained.

A thermal transfer printer in accordance with this Embodiment 7 has the same mechanism structure as that in accordance with Embodiment 3. Further, the thermal transfer printer in accordance with this Embodiment 7 also has the same system structure as that in accordance with Embodiment 3 fundamentally. The thermal transfer printer in accordance with this Embodiment 7 differs from that in accordance with Embodiment 3 in that an ink sheet damage calculating unit 10*b* calculates the degree of damage which the ink sheet 3 will receive on the basis of the first through fourth thresholds, and a selection of a printing operation carried out by a printing operation selecting unit 10*c* is targeted for the first print of the next print order. More specifically, the ink sheet damage calculating unit 10*b* in accordance with Embodiment 7 is constructed in such a way as to compare image element density data of each of areas into which an inputted image is divided by an image area dividing unit 10*a* with the first threshold set correspondingly to each of the areas to calculate the total number of pixels each having density data equal to or larger than the first threshold for each of the areas, compare the total number of pixels calculated for each of the areas with the third threshold larger than the second threshold, the third threshold set correspondingly to each area, and, when the above-mentioned total number of pixels calculated is larger than the second threshold and is smaller than the third threshold, compare the above-mentioned image element density data of each area adjacent to the area which is the target for the calculation with the fourth threshold set correspondingly to the above-mentioned adjacent area.

Further, the printing operation selecting unit 10*c* carries out a control operation of forming a print image of the first print of the next print order by using ink areas in a new unit area when it is determined that the degree of damage which the ink sheet will receive when printing the last odd-numbered screen of the current print order is large regardless of the ink areas used for the print of the last odd-numbered screen of the current print order, whereas when it is determined that the degree of damage which the ink sheet will receive when printing the last odd-numbered screen of the current print order is small, the printing operation selecting unit carries out a control operation of forming a print image of the first print of the next print order by using yet-to-used areas in the ink areas used for the print of the last odd-numbered screen of the current print order. Hereafter, in this embodiment, a case of producing a print of the last odd-numbered screen of the current print order by using the rewind side ink areas Y2, M2, C2, and OP2 will be explained.

Next, a method of determining the degree of damage which the ink sheet will receive in accordance with this Embodiment 7 will be explained. FIGS. 20 to 23 are flow charts showing a determining process on the inputted image data for printing the last odd-numbered screen of the current print order, which is carried out by an ink sheet damage determining unit 10 in accordance with this Embodiment 7. This process is carried out before a print of the last odd-numbered screen of the current print order is produced. First, the image area dividing unit 10*a* divides the last odd-numbered image data of the current print order into image data about a predetermined number of areas in an image area dividing process ST1 (step ST1). In this embodiment, the image area of the inputted image data is divided into four areas (areas a1, a2, a3, and a4), as shown in FIG. 5, like in the case of Embodiment 1, and these areas a1, a2, a3, and a4 are sorted in descending order of the degree of damage which the ink sheet will receive as follows:

$$a1=a2>a3>a4$$

Further, first thresholds Th11, Th12, Th13, and Th14, second thresholds Th21, Th22, Th23, and Th24, third thresholds Th31, Th32, Th33, and Th34, and fourth thresholds Th41, Th42, Th43, and Th44 are set to the areas a1, a2, a3, and a4, respectively. A relationship between the second threshold and the third threshold for each area is set up in such a way that the third threshold is larger than the second threshold. That is, the following relationships: Th21<Th31, Th22<Th32, Th23<Th33, and Th24<Th34 are established. Further, the fourth threshold is set to be equal to or larger than the second threshold. That is, the following relationships: Th41≤Th21, Th42≤Th22, Th43≤Th23, and Th44≤Th24 are established. These thresholds are determined according to conditions including the type of the ink sheet and a grayscale table for determining the energy applied from a thermal head 5 to the ink sheet, and can be predetermined from the results of carrying out an experiment on each of the conditions.

Next, in an image data threshold process (step ST2) carried out by the ink sheet damage calculating unit 10*b*, the ink sheet damage calculating unit carries out the threshold process by using the first threshold, like that in accordance with Embodiment 1. A number-of-pixels-equal-to-or-greater-than-first-threshold calculating process (step ST3) is the same as that in accordance with Embodiment 3. Hereafter, a method of determining the degree of damage which the ink sheet will receive in each area will be explained.

First, in an ink sheet damage determining process on the area a1 (step ST31), the ink sheet damage calculating unit compares the number of pixels of each of Y, M, and C color data in the area a1, which is determined in the number-of-pixels-equal-to-or-greater-than-first-threshold calculating process (step ST3), each pixel having density data equal to or larger than the first threshold, with the second threshold. More specifically, the ink sheet damage calculating unit compares each of the numbers of pixels Sa1Y, Sa1M, and Sa1C in the area a1 each having density data equal to or larger than the first threshold with the second threshold Th21. When the results of all the comparison cases for Y, M, and C colors show that the number of pixels is smaller than the second threshold, the ink sheet damage calculating unit determines that the degree of damage which the ink sheet will receive in the area a1 is small, and no influence of the ink sheet damage is exerted upon the next screen print, and then shifts to a damage determining operation A on the next area 2. In contrast, when the results of the comparisons show that the number of pixels is equal to or larger than the second threshold in at least one of all the comparison cases, the ink sheet damage calculating unit compares the number of pixels of color data each having density data equal to or larger than the second threshold, among the numbers of pixels of Y, M, and C color data in the area a1, each pixel having density data equal to or larger than the first threshold, which are determined in the number-of-pixels-equal-to-or-greater-than-first-threshold calculating process (step ST3), with the third threshold in a second ink sheet damage determining process (step ST32). More specifically, the ink sheet damage calculating unit compares the number of pixels of color data each having density data equal to or larger than the second threshold Th21, among the numbers of pixels Sa1Y, Sa1M, and Sa1C in the area a1 each having density data equal to or larger than the first threshold, with the third threshold Th31, and, when the results of these comparisons show that the number of pixels is equal to or larger than the third threshold in at least one of all the comparison cases, determines that the degree of damage which the ink sheet will receive is large and the influence of the ink sheet damage on the next screen print is large, and sets the next printing operation command to a "normal print" in a printing operation command determining process (step ST34), and the first printing operation command of the next print order is stored in the printing operation selecting unit 10*c* in a next printing operation command storing process (step ST35). Then, the first print of the next print order is produced by using the next new ink screen.

Further, when the number of pixels of color data each having density data equal to or larger than the second threshold is smaller than the third threshold in the second ink sheet damage determining process (step ST32), the ink sheet damage calculating unit determines that the degree of damage which the ink sheet will receive is "medium," and, in a third ink sheet damage determining process (step ST33), compares the numbers of pixels of the same color data as the color data in the area a1 in which the number of pixels is equal to or larger than the second threshold and is smaller than the third threshold, among the numbers of pixels of all color data in the areas a3 and 4 adjacent to the above-mentioned area a1, each pixel having density data equal to or larger than the first threshold, which are determined in the number-of-pixels-equal-to-or-greater-than-first-threshold calculating process (step ST3), with the fourth thresholds set to the areas a3 and a4, respectively. More specifically, the ink sheet damage calculating unit compares the numbers of pixels of the same color data as the color data in the area a1 in which the number of pixels is equal to or larger than the second threshold and is smaller than the third threshold, among the numbers of pixels Sa3Y, Sa3M, and Sa3C in the area a3 each having density data equal to or larger than the first threshold, with the fourth threshold Th43, and compares the numbers of pixels of the same color data as the color data in the area a1 in which the number of pixels is equal to or larger than the second threshold and is smaller than the third threshold, among the numbers of pixels Sa4Y, Sa4M, and Sa4C in the area a4 each having density data equal to or larger than the first threshold, with the fourth threshold Th44. For example, when the color data in the area a1 in which the number of pixels is equal to or larger than the second threshold and is smaller than the third threshold is the Y color data Sal Y, the ink sheet damage calculating unit compares Sa3Y with Th43 and also compares Sa4Y with Th44. When the results of all the comparison cases show that there is a case in which the number of pixels is equal to or larger than the fourth threshold, the ink sheet damage calculating unit determines that the degree of damage which the ink sheet will receive in the area a1 is large and the influence of the ink sheet damage on the next screen print is large, and sets the next printing operation command to a "normal print" in the printing operation command determining process (step ST34), and the first printing operation command of the next print order is stored in the printing operation selecting unit 10*c* in the next printing operation command storing process (step ST35). Then, the first print of the next print order is produced by using the next new ink screen.

In contrast, when the results of all the comparison cases show that the number of pixels is smaller than the fourth threshold in the third ink sheet damage determining process (step ST33), the ink sheet damage calculating unit determines that the influence of the ink sheet damage on the next screen print is small, and then shifts to a damage determining operation A on the next area 2.

Figure 21:
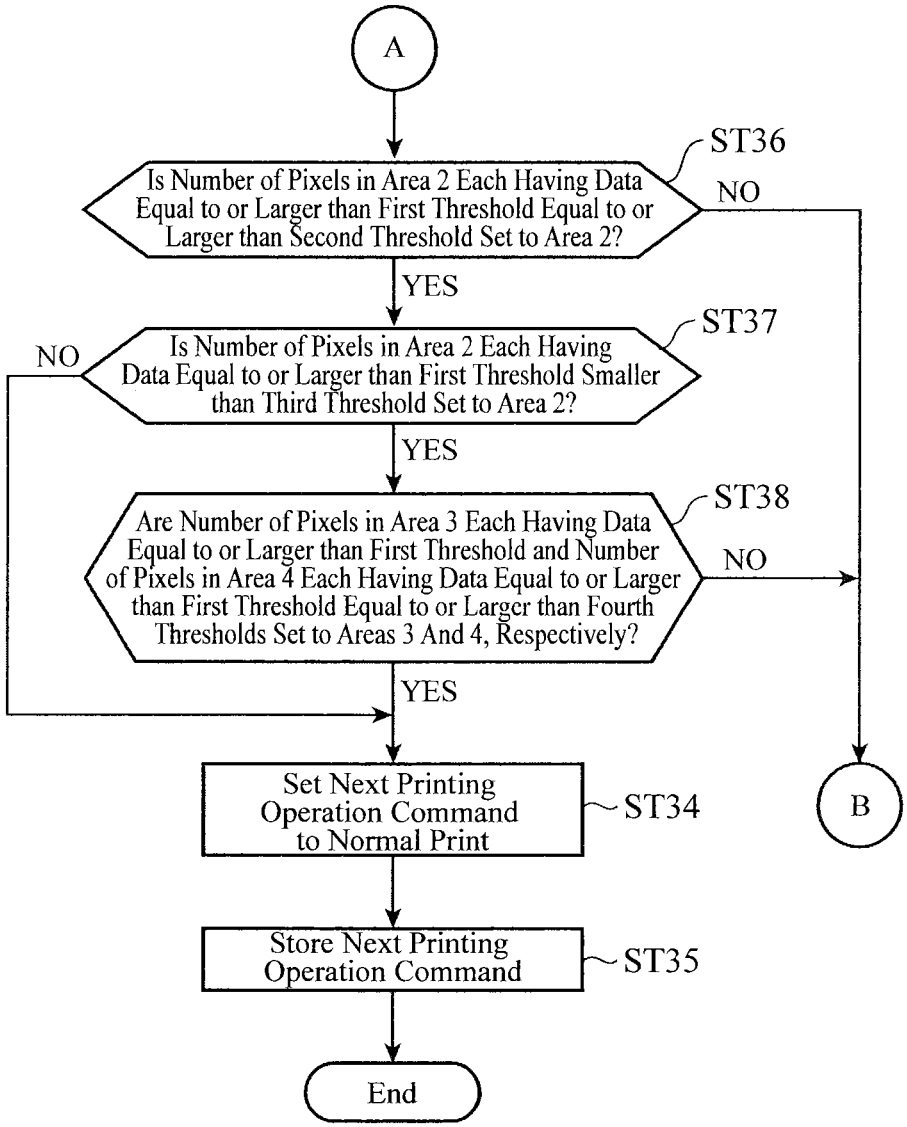
FIG. 21 is a flow chart showing a determining process of determining whether an ink sheet damage occurs in a second divided region in the print control device in accordance with Embodiment 7 of the present invention.

Next, the ink sheet damage determining process on the area a2 will be explained with reference to FIG. 21. First, in an ink sheet damage determining process on the area a2 (step ST36), the ink sheet damage calculating unit compares the number of pixels of each of Y, M, and C color data in the area a2, which is determined in the number-of-pixels-equal-to-or-greater-than-first-threshold calculating process (step ST3), each pixel having density data equal to or larger than the first threshold, with the second threshold. More specifically, the ink sheet damage calculating unit compares each of the numbers of pixels Sa2Y, Sa2M, and Sa2C in the area a2 each having density data equal to or larger than the first threshold with the second threshold Th22. When the results of all the comparison cases for Y, M, and C colors show that the number of pixels is smaller than the second threshold, the ink sheet damage calculating unit determines that the degree of damage which the ink sheet will receive in the area a2 is small, and no influence of the ink sheet damage is exerted upon the next screen print, and then shifts to a damage determining operation B on the next area 3. In contrast, when the results of the comparisons show that the number of pixels is equal to or larger than the second threshold in at least one of all the comparison cases, the ink sheet damage calculating unit compares the number of pixels of color data each having density data equal to or larger than the second threshold, among the numbers of pixels of Y, M, and C color data in the area a2, each pixel having density data equal to or larger than the first threshold, which are determined in the number-of-pixels-equal-to-or-greater-than-first-threshold calculating process (step ST3), with the third threshold in a second ink sheet damage determining process (step ST37). More specifically, the ink sheet damage calculating unit compares the number of pixels of color data each having density data equal to or larger than the second threshold Th22, among the numbers of pixels Sa2Y, Sa2M, and Sa2C in the area a2 each having density data equal to or larger than the first threshold, with the third threshold Th32, and, when the results of these comparisons show that the number of pixels is equal to or larger than the third threshold in at least one of all the comparison cases, determines that the degree of damage which the ink sheet will receive is large and the influence of the ink sheet damage exerted upon the next screen print is large, and sets the next printing operation command to a "normal print" in the printing operation command determining process (step ST34), and the first printing operation command of the next print order is stored in the printing operation selecting unit 10*c* in the next printing operation command storing process (step ST35). Then, the first print of the next print order is produced by using the next new ink screen.

Further, when the number of pixels of color data each having density data equal to or larger than the second threshold is less than the third threshold in the second ink sheet damage determining process (step ST37), the ink sheet damage calculating unit determines that the degree of damage which the ink sheet will receive is "medium," and, in a third ink sheet damage determining process (step ST38), compares the numbers of pixels of the same color data as the color data in the area a2 in which the number of pixels is equal to or larger than the second threshold and is smaller than the third threshold, among the numbers of pixels of all color data in the areas a3 and 4 adjacent to the above-mentioned area a2, each pixel having density data equal to or larger than the first threshold, which are determined in the number-of-pixels-equal-to-or-greater-than-first-threshold calculating process (step ST3), with the fourth thresholds set to the areas a3 and a4, respectively. More specifically, the ink sheet damage calculating unit compares the numbers of pixels of the same color data as the color data in the area a2 in which the number of pixels is equal to or larger than the second threshold and is smaller than the third threshold, among the numbers of pixels Sa3Y, Sa3M, and Sa3C in the area a3 each having density data equal to or larger than the first threshold, with the fourth threshold Th43, and compares the numbers of pixels of the same color data as the color data in the area a2 in which the number of pixels is equal to or larger than the second threshold and is smaller than the third threshold, among the numbers of pixels Sa4Y, Sa4M, and Sa4C in the area a4 each having density data equal to or larger than the first threshold, with the fourth threshold Th44. For example, when the color data in the area a2 in which the number of pixels is equal to or larger than the second threshold and is smaller than the third threshold is the Y color data Sa2Y, the ink sheet damage calculating unit compares Sa3Y with Th43 and also compares Sa4Y with Th44. When the results of all the comparison cases show that there is case in which the number of pixels is equal to or larger than the fourth threshold, the ink sheet damage calculating unit determines that the degree of damage which the ink sheet will receive in the area a2 is large and the influence of the ink sheet damage on the next screen print is large, and sets the next printing operation command to a "normal print" in the printing operation command determining process (step ST34), and the first printing operation command of the next print order is stored in the printing operation selecting unit 10*c* in the next printing operation command storing process (step ST35). Then, the first print of the next print order is produced by using the next new ink screen.

In contrast, when the results of all the comparison cases show that the number of pixels is smaller than the fourth threshold in the third ink sheet damage determining process (step ST38), the ink sheet damage calculating unit determines that the influence of the ink sheet damage on the next screen print is small, and then shifts to a damage determining operation B on the next area 2.

Figure 22:
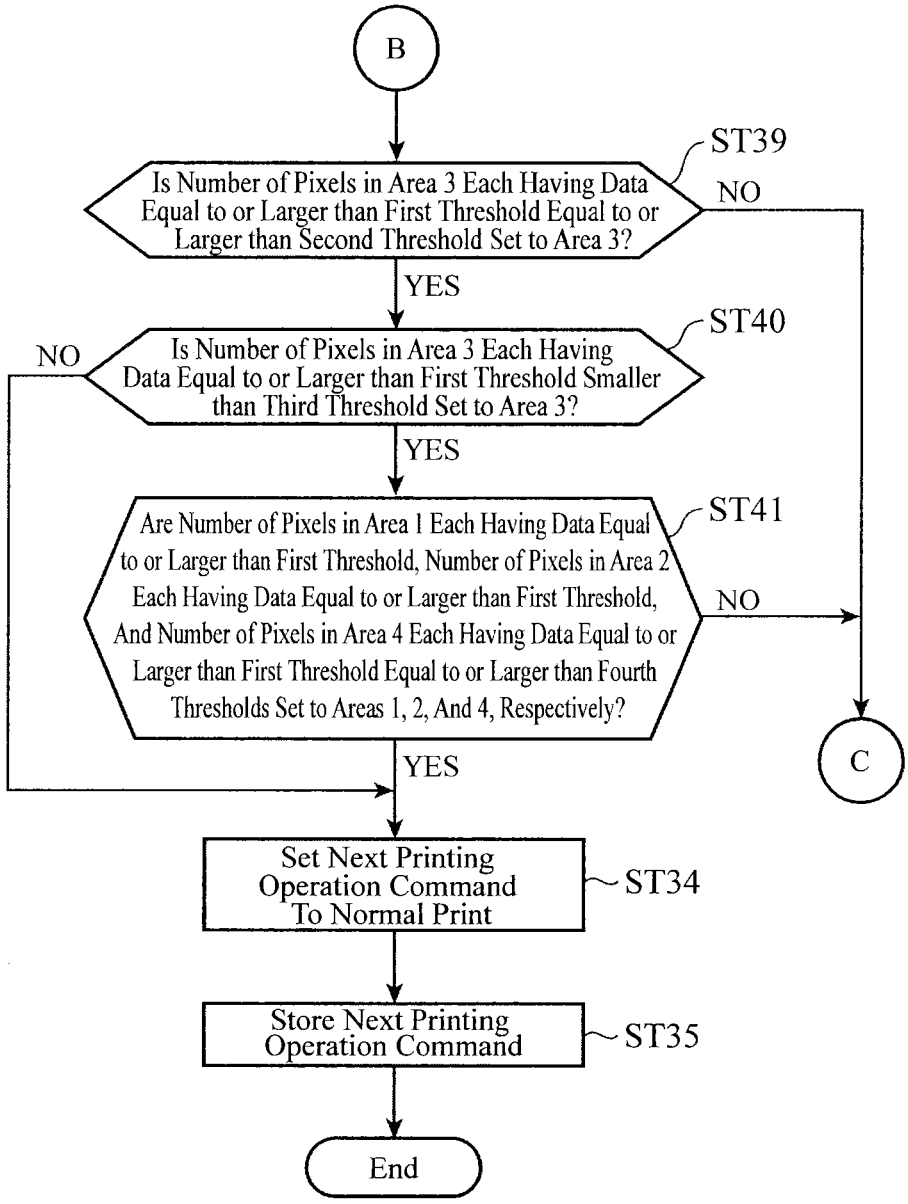
FIG. 22 is a flow chart showing a determining process of determining whether an ink sheet damage occurs in a third divided region in the print control device in accordance with Embodiment 7 of the present invention.

Next, the ink sheet damage determining process on the area a3 will be explained with reference to FIG. 22. First, in an ink sheet damage determining process on the area a3 (step ST39), the ink sheet damage calculating unit compares the number of pixels of each of Y, M, and C color data in the area a3, which is determined in the number-of-pixels-equal-to-or-greater-than-first-threshold calculating process (step ST3), each pixel having density data equal to or larger than the first threshold, with the second threshold. More specifically, the ink sheet damage calculating unit compares each of the numbers of pixels Sa3Y, Sa3M, and Sa3C in the area a3 each having density data equal to or larger than the first threshold with the second threshold Th23. When the results of all the comparison cases for Y, M, and C colors show that the number of pixels is smaller than the second threshold, the ink sheet damage calculating unit determines that the degree of damage which the ink sheet will receive in the area a3 is small, and no influence of the ink sheet damage is exerted upon the next screen print, and then shifts to a damage determining operation C on the next area 3. In contrast, when the results of the comparisons show that the number of pixels is equal to or larger than the second threshold in at least one of all the comparison cases, the ink sheet damage calculating unit compares the number of pixels of color data each having density data equal to or larger than the second threshold, among the numbers of pixels of Y, M, and C color data in the area a3, each pixel having density data equal to or larger than the first threshold, which are determined in the number-of-pixels-equal-to-or-greater-than-first-threshold calculating process (step ST3), with the third threshold in a second ink sheet damage determining process (step ST40). More specifically, the ink sheet damage calculating unit compares the number of pixels of color data each having density data equal to or larger than the second threshold Th23, among the numbers of pixels Sa3Y, Sa3M, and Sa3C in the area a3 each having density data equal to or larger than the first threshold, with the third threshold Th33, and, when the results of these comparisons show that the number of pixels is equal to or larger than the third threshold in at least one of all the comparison cases, determines that the degree of damage which the ink sheet will receive is large and the influence of the ink sheet damage exerted upon the next screen print is large, and sets the next printing operation command to a "normal print" in the printing operation command determining process (step ST34), and the first printing operation command of the next print order is stored in the printing operation selecting unit 10*c* in the next printing operation command storing process (step ST35). Then, the first print of the next print order is produced by using the next new ink screen.

Further, when the number of pixels of color data each having density data equal to or larger than the second threshold is less than the third threshold in the second ink sheet damage determining process (step ST40), the ink sheet damage calculating unit determines that the degree of damage which the ink sheet will receive is "medium," and, in a third ink sheet damage determining process (step ST41), compares the numbers of pixels of the same color data as the color data in the area a3 in which the number of pixels is equal to or larger than the second threshold and is smaller than the third threshold, among the numbers of pixels of all color data in the areas a1, a2, and a4 adjacent to the above-mentioned area a3, each pixel having density data equal to or larger than the first threshold, which are determined in the number-of-pixels-equal-to-or-greater-than-first-threshold calculating process (step ST3), with the fourth thresholds set to the areas a1, a2, and a4, respectively. More specifically, the ink sheet damage calculating unit compares the numbers of pixels of the same color data as the color data in the area a3 in which the number of pixels is equal to or larger than the second threshold and is smaller than the third threshold, among the numbers of pixels Sa1Y, Sa1M, and Sa1C in the area a1, each pixel having density data equal to or larger than the first threshold, with the fourth threshold Th41, compares the numbers of pixels of the same color data as the color data in the area a3 in which the number of pixels is equal to or larger than the second threshold and is smaller than the third threshold, among the numbers of pixels Sa2Y, Sa2M, and Sa2C in the area a2, each pixel having density data equal to or larger than the first threshold, with the fourth threshold Th42, and compares the numbers of pixels of the same color data as the color data in the area a3 in which the number of pixels is equal to or larger than the second threshold and is smaller than the third threshold, among the numbers of pixels Sa4Y, Sa4M, and Sa4C in the area a4, each pixel having density data equal to or larger than the first threshold, with the fourth threshold Th44. For example, when the color data in the area a3 in which the number of pixels is equal to or larger than the second threshold and is smaller than the third threshold is the Y color data Sa3Y, the ink sheet damage calculating unit compares Sal Y with Th41, also compares Sa2Y with Th42, and further compares Sa4Y with Th44. When the results of all the comparison cases show that there is case in which the number of pixels is equal to or larger than the fourth threshold, the ink sheet damage calculating unit determines that the degree of damage which the ink sheet will receive in the area a3 is large and the influence of the ink sheet damage on the next screen print is large, and sets the next printing operation command to a "normal print" in the printing operation command determining process (step ST34), and the first printing operation command of the next print order is stored in the printing operation selecting unit 10*c* in the next printing operation command storing process (step ST35). Then, the first print of the next print order is produced by using the next new ink screen.

In contrast, when the results of all the comparison cases show that the number of pixels is smaller than the fourth threshold in the third ink sheet damage determining process (step ST41), the ink sheet damage calculating unit determines that the influence of the ink sheet damage on the next screen print is small, and then shifts to a damage determining operation C on the next area 2.

Figure 23:
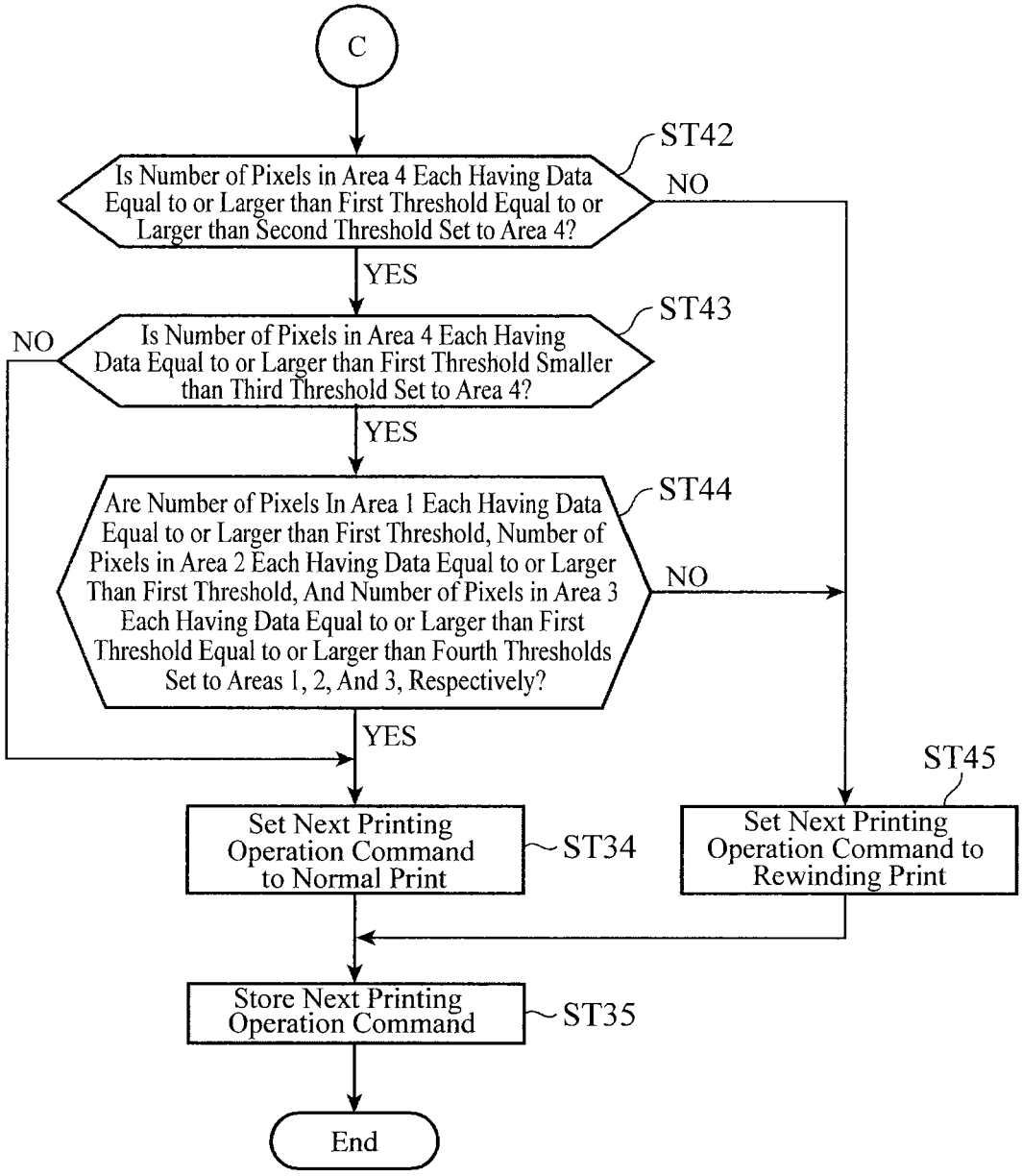
FIG. 23 is a flowchart showing a determining process of determining whether an ink sheet damage occurs in a fourth divided region in the print control device in accordance with Embodiment 7 of the present invention.

Next, the ink sheet damage determining process on the area a4 will be explained with reference to FIG. 23. First, in an ink sheet damage determining process on the area a4 (step ST42), the ink sheet damage calculating unit compares the number of pixels of each of Y, M, and C color data in the area a4, which is determined in the number-of-pixels-equal-to-or-greater-than-first-threshold calculating process (step ST3), each pixel having density data equal to or larger than the first threshold, with the second threshold. More specifically, the ink sheet damage calculating unit compares each of the numbers of pixels Sa4Y, Sa4M, and Sa4C in the area a4 each having density data equal to or larger than the first threshold with the second threshold Th24. When the results of all the comparison cases for Y, M, and C colors show that the number of pixels is smaller than the second threshold, the ink sheet damage calculating unit determines that the degree of damage which the ink sheet will receive in the area a2 is small, and no influence of the ink sheet damage is exerted upon the next screen print, and, in a printing operation command determining process (step ST45), the ink sheet damage calculating unit sets the next printing operation command to a "rewinding print", and the first printing operation command of the next print order is stored in the printing operation selecting unit 10*c* in the next printing operation command storing process (step ST35). Then, the ink sheet 3 is rewound and the rewind side ink areas Y1, M1, C1, and OP1 which are yet-to-be-used areas in the ink areas which have been used last time for an immediate previous order are used to produce the first print of the next print order.

In contrast, when the results of the comparisons show that the number of pixels is equal to or larger than the second threshold in at least one of all the comparison cases, the ink sheet damage calculating unit compares the number of pixels of color data each having density data equal to or larger than the second threshold, among the numbers of pixels of Y, M, and C color data in the area a4, each pixel having density data equal to or larger than the first threshold, which are determined in the number-of-pixels-equal-to-or-greater-than-first-threshold calculating process (step ST3), with the third threshold in a second ink sheet damage determining process (step ST43). More specifically, the ink sheet damage calculating unit compares the number of pixels of color data each having density data equal to or larger than the second threshold Th24, among the numbers of pixels Sa4Y, Sa4M, and Sa4C in the area a4, each pixel having density data equal to or larger than the first threshold, with the third threshold Th34, and, when the results of these comparisons show that the number of pixels is equal to or larger than the third threshold in at least one of all the comparison cases, determines that the degree of damage which the ink sheet will receive is large and the influence of the ink sheet damage exerted on the next screen print is large, and sets the next printing operation command to a "normal print" in the printing operation command determining process (step ST34), and the first printing operation command of the next print order is stored in the printing operation selecting unit 10*c* in the next printing operation command storing process (step ST35). Then, the first print of the next print order is produced by using the next new ink screen.

Further, when the number of pixels of color data each having density data equal to or larger than the second threshold is smaller than the third threshold in the second ink sheet damage determining process (step ST43), the ink sheet damage calculating unit determines that the degree of damage which the ink sheet will receive is "medium," and, in a third ink sheet damage determining process (step ST44), compares the numbers of pixels of the same color data as the color data in the area a4 in which the number of pixels is equal to or larger than the second threshold and is smaller than the third threshold, among the numbers of pixels of all color data in the areas a1, a2, and a3 adjacent to the above-mentioned area a4, each pixel having density data equal to or larger than the first threshold, which are determined in the number-of-pixels-equal-to-or-greater-than-first-threshold calculating process (step ST3), with the fourth thresholds set to the areas a1, a2, and a3, respectively. More specifically, the ink sheet damage calculating unit compares the numbers of pixels of the same color data as the color data in the area a4 in which the number of pixels is equal to or larger than the second threshold and is smaller than the third threshold, among the numbers of pixels Sa1Y, Sa1M, and Sa1C in the area a1 each having density data equal to or larger than the first threshold, with the fourth threshold Th41, compares the numbers of pixels of the same color data as the color data in the area a4 in which the number of pixels is equal to or larger than the second threshold and is smaller than the third threshold, among the numbers of pixels Sa2Y, Sa2M, and Sa2C in the area a2 each having density data equal to or larger than the first threshold, with the fourth threshold Th42, and compares the numbers of pixels of the same color data as the color data in the area a4 in which the number of pixels is equal to or larger than the second threshold and is smaller than the third threshold, among the numbers of pixels Sa3Y, Sa3M, and Sa3C in the area a3 each having density data equal to or larger than the first threshold, with the fourth threshold Th43. For example, when the color data in the area a4 in which the number of pixels is equal to or larger than the second threshold and is smaller than the third threshold is the Y color data Sa4Y, the ink sheet damage calculating unit compares Sa1Y with Th41, also compares Sa2Y with Th42, and further compares Sa3Y with Th43. When the results of all the comparison cases show that there is case in which the number of pixels is equal to or larger than the fourth threshold, the ink sheet damage calculating unit determines that the degree of damage which the ink sheet will receive in the area a4 is large and the influence of the ink sheet damage exerted on the next screen print is large, and sets the next printing operation command to a "normal print" in the printing operation command determining process (step ST34), and the first printing operation command of the next print order is stored in the printing operation selecting unit 10*c* in the next printing operation command storing process (step ST35). Then, the first print of the next print order is produced by using the next new ink screen.

Further, when the results of all the comparison cases show that the number of pixels is smaller than the fourth threshold in the third ink sheet damage determining process (step ST44), the ink sheet damage calculating unit determines that the influence of the ink sheet damage exerted on the next screen print is small, and sets the next printing operation command to a "rewinding print" in the printing operation command determining process (step ST45), and the first printing operation command of the next print order is stored in the printing operation selecting unit 10*c* in the next printing operation command storing process (step ST35). Then, the ink sheet 3 is rewound and the rewind side ink areas Y1, M1, C1, and OP1 which are yet-to-be-used areas in the ink areas which have been used last time for the immediate previous order are used to produce the first print of the next print order.

Hereafter, the reason for determining the degree of damage which the ink sheet will receive in another area adjacent to the target for the determination by using the fourth threshold will be explained. The degree of damage which the ink sheet 3 will receive is determined by the heat energy applied to the ink sheet from the thermal head 5, and the heat energy has a thermal influence on adjacent areas through a thermal storage, heat conduction, etc. Therefore, when the amount of heat energy applied to another area adjacent to the target area for the determination is large, the heat energy applied to the target area for the determination also becomes large, and the possibility that the degree of damage which the ink sheet will receive in the target area for the determination also becomes high. In contrast with this, when the amount of heat energy applied to another area adjacent to the target area for the determination is small, the target area for the determination hardly receives any thermal influence of an adjacent area, and the degree of damage which the ink sheet will receive in the target area for the determination does not become so large. That is, when the degree of damage which the ink sheet will receive in the target area for the determination is "medium," there is a necessity to refer to the degree of damage which the ink sheet will receive in another area adjacent to the target area because there is a possibility that the degree of damage which the ink sheet will receive in the target area for the determination is "large" according to the degree of damage which the ink sheet will receive in the adjacent area. For the above-mentioned reason, when the degree of damage which the ink sheet will receive in the target area for the determination is "medium," the print control device can determine the degree of damage which the ink sheet will receive in the target area for the determination with a higher degree of accuracy by referring to the degree of damage which the ink sheet will receive in another area adjacent to the target area.

Although the case of using the rewind side ink areas Y2, M2, C2, and OP2 to produce a print of the last odd-numbered screen of the current print order is explained in Embodiment 7, the rewind side ink areas Y1, M1, C1, and OP1 can be alternatively used to produce a print of the last odd-numbered screen of the current print order. In this case, it is determined that the damage of degree which the ink sheet will receive is small, the ink sheet 3 is rewound, and the yet-to-be-used areas in the ink areas which are to be used for the first print of the next print order and which have been used last time for the immediate previous order are the rewind side areas Y2, M2, C2, and OP2.

As explained above, in accordance with Embodiment 7, because there is provided a print control device for use in a thermal transfer printer that puts an ink sheet and a recording paper on top of each other, and, while conveying the ink sheet, produces a plurality of heat transfer prints of an image in units of a predetermined size, the plurality of heat transfer prints extending on the recording paper in a direction of the conveyance and the image having a size smaller than the predetermined size, the print control device including: an image area dividing unit for dividing an image to be printed into a plurality of areas; an ink sheet damage calculating unit for comparing image element density data of each of the areas into which the inputted image is divided with a first threshold set correspondingly to the area to calculate the total number of pixels each having density data equal to or larger than the first threshold for each of the areas, for comparing the total number of pixels calculated for the area with a second threshold set correspondingly to the area, with a third threshold larger than the second threshold, and with a fourth threshold equal to or smaller than the second threshold; and a printing operation selecting unit for, when the plurality of areas include an area in which the calculated total number of pixels is equal to or larger than the third threshold or an area in which the calculated total number of pixels is equal to or larger than the second threshold and is smaller than the third threshold and the calculated total number of pixels for any other area adjacent to the area which is the target for calculation is equal to or larger than the fourth threshold set to the adjacent area, carrying out a control operation of forming a next print image by using an ink area in a new unit area, and for, when the calculated total number of pixels is smaller than the second threshold in every one of all the areas or when the calculated total number of pixels is equal to or larger than the second threshold and is smaller than the third threshold and there is another area adjacent to the target area for calculation in which the calculated total number of pixels is smaller than the fourth threshold set to the adjacent area, carrying out a control operation of forming a next print image by using a remaining area of an already-used ink area in a unit area having the predetermined size, the number of wrinkles which occur in the ink sheet and the degree of damage which occurs in the ink sheet can be reduced and prints having high print quality can be acquired, while the use efficiency of the ink sheet can be improved.

Embodiment 8.

In above-mentioned Embodiment 7, fixed values are used as the first through fourth thresholds which are used when dividing the image area to be printed into a plurality of areas and determining the degree of damage which the ink sheet will receive in each of the areas, respectively. In contrast with this, in this Embodiment 8, an example of changing the above-mentioned first through fourth thresholds according to both the number of remaining ink screens of an ink sheet and the environmental temperature will be explained.

First, the reason for changing the first through fourth thresholds for each of the areas according to both the number of remaining ink screens and the environmental temperature will be explained. As previously explained, when the degree of damage which the ink sheet will receive is large, an appropriate tension or the like cannot be applied to the ink sheet and wrinkles easily occur in the ink sheet. Wrinkles easily occur in the ink sheet when the ink sheet is rewound. Particularly when the tension applied to the ink sheet at the time of rewinding the ink sheet 3 becomes large, wrinkles easily occur in the ink sheet. The larger diameter an ink sheet supply reel 4*a* has, the larger rewind tension is applied to the ink sheet 3. Because the diameter of the ink sheet supply reel 4*a* is proportional to the number of remaining ink screens, the ink rewind tension can be estimated by detecting the number of remaining ink screens. Further, because the rigidity of the ink sheet decreases with increase in the environmental temperature, wrinkles easily occur in the ink sheet when the environmental temperature is high. As can be seen from the above description, it becomes possible to estimate whether or not the possibility that wrinkles occur in the ink sheet is high by detecting both the number of remaining ink screens and the environmental temperature.

Figure 24:
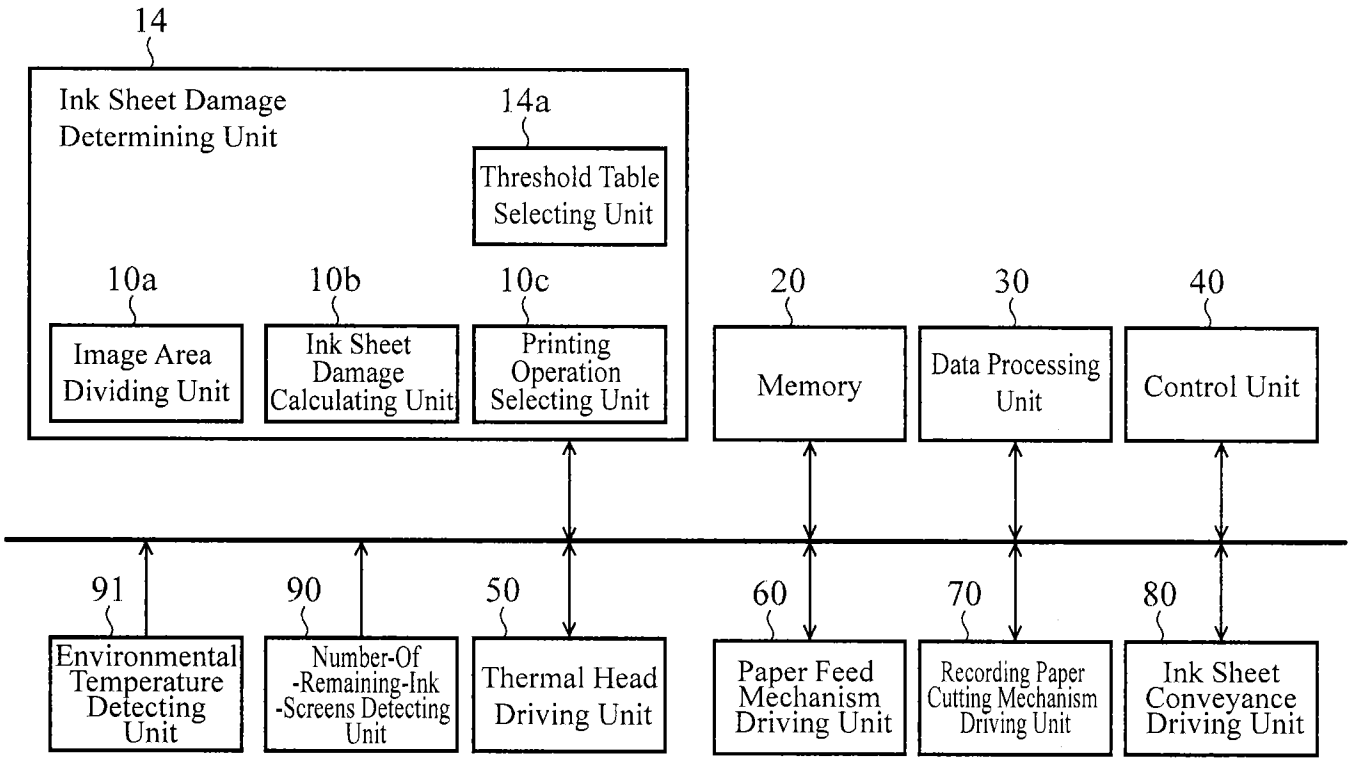
FIG. 24 is a block diagram showing the system structure of a print control device in accordance with Embodiment 8 of the present invention.

Because the mechanism structure of a thermal transfer printer in accordance with Embodiment 8 is the same as that in accordance with Embodiment 7, the explanation of the mechanism structure will be omitted hereafter. FIG. 24 is a block diagram showing the system structure of the thermal transfer printer in accordance with Embodiment 8. The system shown in the figure is fundamentally the same as that in accordance with Embodiment 7. The thermal transfer printer in accordance with Embodiment 8 differs from that in accordance with Embodiment 7 in that the thermal transfer printer includes a remaining ink screen detecting unit 90 for detecting the number of remaining ink screens, and an environmental temperature detecting unit 91 for detecting the environmental temperature, and an ink sheet damage determining unit 14 includes a threshold table selecting unit 14*a* for selecting a threshold table for use in an ink sheet damage calculating unit 10*b* from the results of the detection by the number-of-remaining-ink-screens detecting unit 90 and the results of the detection by the environmental temperature detecting unit 91.

Next, a threshold table selecting operation will be explained. The threshold table is a set of first through fourth thresholds set to each divided area. In this embodiment, a case of selecting a table from the following two tables: a "normal" threshold table used in Embodiment 7 and a threshold table "for small diameter and high temperature" which is used when the number of ink screens decreases (when the diameter of the ink sheet supply reel 4*a* is small) or when the environmental temperature is high will be explained. The two threshold tables have the following large and small relationship between their thresholds: the "normal" threshold table>the threshold table "for small diameter and high temperature," and it is determined more easily when using the threshold table "for small diameter and high temperature" than when using the "normal" threshold table that the degree of damage which the ink sheet will receive is large.

Figure 25:
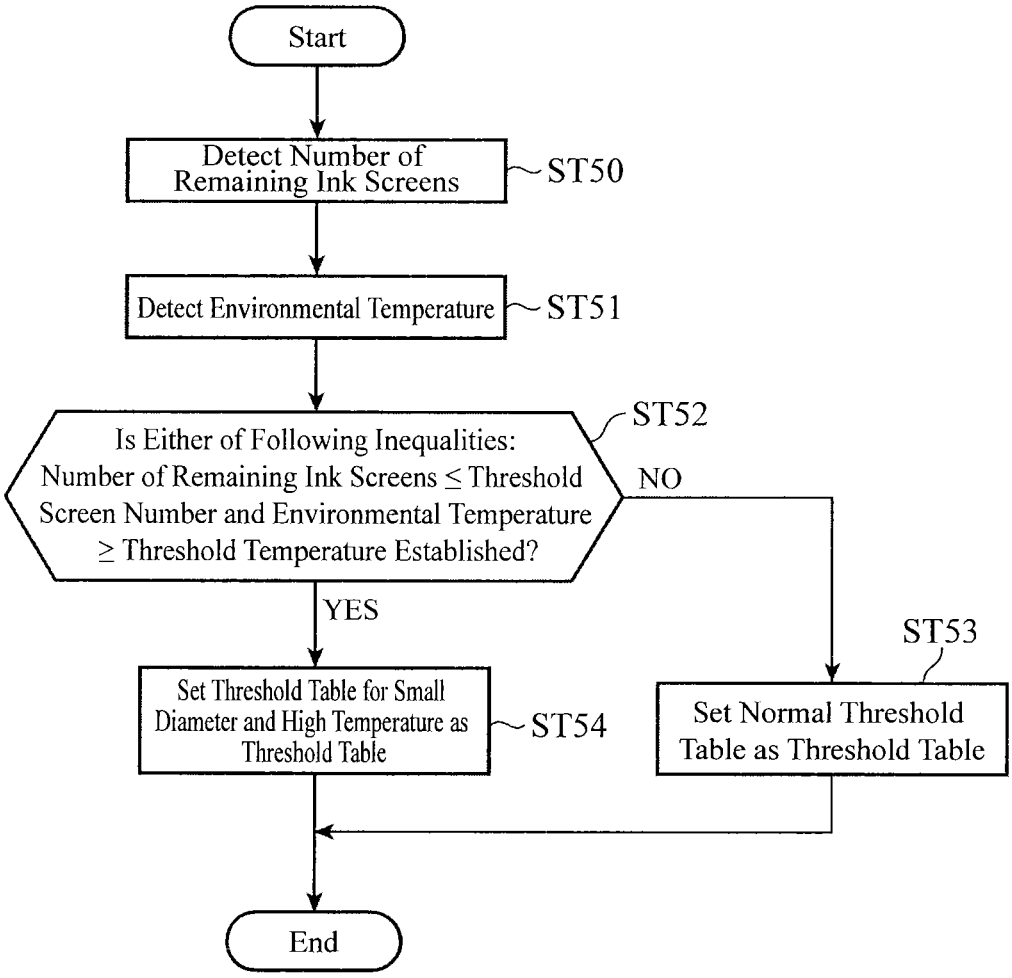
FIG. 25 is a flow chart showing a determining process of determining whether an ink sheet damage occurs in the print control device in accordance with Embodiment 8 of the present invention.

FIG. 25 is a flow chart showing a process of selecting a threshold table for use in the ink sheet damage calculating unit 10*b*, which is carried out by the threshold table selecting unit 14*a* of the ink sheet damage determining unit 14 in accordance with Embodiment 8. First, the number-of-remaining-ink-screens detecting unit 90 detects the number of remaining ink screens in a remaining ink screen detecting process (step ST50). More specifically, the number-of-remaining-ink-screens detecting unit 90 detects the number of remaining ink screens by reading the ink remaining amount information in an RF-ID tag disposed in the ink sheet supply reel 4*a* using a not shown reader. Next, the environmental temperature detecting unit 91 detects the environmental temperature in an environmental temperature detecting process (step ST51). More specifically, the environmental temperature detecting unit converts an analog signal from a thermistor mounted in the vicinity of a thermal head 5 or the conveying path of the ink sheet 3 into a digital signal value by using a not shown A/D converter, and detects the converted value as the temperature.

Next, the ink sheet damage determining unit compares both the detected number of the remaining ink screens and the detected environmental temperature with both a threshold number of screens and a threshold temperature which are preset to the threshold table selecting unit 14*a*, respectively, in a detection information comparing process (step ST52). When the detected number of remaining ink screens is equal to or smaller than the threshold number of screens or when the detected environmental temperature is equal to or higher than the threshold temperature, the ink sheet damage determining unit sets the threshold table "for small diameter and high temperature" as the threshold table for use in the ink sheet damage calculating unit 10*b* to in a threshold table setting process (step ST54). In contrast, when the detected number of remaining ink screens exceeds the threshold number of screens or when the detected environmental temperature is lower than the threshold temperature, the ink sheet damage determining unit sets the "normal" threshold table as the threshold table for use in the ink sheet damage calculating unit 10*b* to in a threshold table setting process (step ST53). Subsequent ink sheet damage determining process and printing operation selecting process are the same as Embodiment 7.

Thus, because the thermal transfer printer in accordance with Embodiment 8 properly changes the threshold table used for the determination of the degree of damage which the ink sheet will receive according to both the number of remaining ink sheet screens and the environmental temperature, the thermal transfer printer can determine the degree of damage which the ink sheet will receive (the probability of occurrence of wrinkles) with a high degree of accuracy even on condition that the diameter of the ink sheet supply reel becomes small, and the ink sheet rewind tension at the time of rewinding the ink sheet becomes large and therefore wrinkles occur easily or condition that the environmental temperature becomes high and therefore the rigidity of the ink sheet decreases, and can select ink areas which are used for a first print of a next print order on the basis of the results of the determination. Therefore, the number of wrinkles which occur in the ink sheet and the degree of damage which occurs in the ink sheet can be reduced and prints having high print quality can be acquired, while the use efficiency of the ink sheet can be improved.

While the invention has been described in its preferred embodiments, it is to be understood that an arbitrary combination of two or more of the embodiments can be made, various changes can be made in an arbitrary component in accordance with any one of the embodiments, and an arbitrary component in accordance with any one of the embodiments can be omitted within the scope of the invention.

INDUSTRIAL APPLICABILITY

As mentioned above, the print control device in accordance with the present invention relates to a structure of determining the degree of damage which the ink sheet will receive to control formation of a print image, and is suitable for control of a sublimation type thermal transfer printer that uses a large-size ink sheet to print two or more small-size images.

EXPLANATIONS OF REFERENCE NUMERALS

1 printer, 2 recording paper, 3 ink sheet, 5 thermal head, 10, 11, 12, 13, and 14 ink sheet damage determining unit, 10*a* and 12*a* image area dividing unit, 10*b* and 12*b* ink sheet damage calculating unit, 10*c* and 13*c* printing operation selecting unit, 12*c* image data converting unit, 13*a* thermal head temperature detecting unit, 13*b* detected temperature comparing unit, 14*a* threshold table selecting unit, 8 memory, 30 data processing unit, 40 control unit, 50 thermal head driving unit, 60 paper feed mechanism driving unit, 70 recording paper cutting mechanism driving unit, 80 ink sheet conveyance driving unit, number-of-remaining-ink-screens detecting unit, 91 environmental temperature detecting unit, 200 and 201 image area of inputted image data.

The invention claimed is:

1. A print control device for use in a thermal transfer printer that puts an ink sheet and a recording paper on top of each other, and, while conveying said ink sheet, produces a plurality of heat transfer prints of an image in units of a predetermined size, the plurality of heat transfer prints extending on said recording paper in a direction of said conveyance and the image having a size smaller than said predetermined size, said print control device comprising:

an image area dividing unit for dividing an image to be printed into a plurality of areas;

an ink sheet damage calculating unit for comparing image element density data of each of said areas into which the inputted image is divided with a first threshold set correspondingly to said each of said areas to calculate a total number of pixels each having density data equal to or larger than said first threshold for each of said areas, for comparing the total number of pixels calculated for said each of said areas with a second threshold set correspondingly to said each of said areas and with a third threshold larger than said second threshold, and for, when said plurality of areas include an area in which said calculated total number of pixels is equal to or larger than said second threshold and is smaller than said third threshold, comparing said calculated total number of pixels for another area adjacent to said area with a fourth threshold set to said adjacent area and smaller than the second threshold; and a printing operation selecting unit for, when said calculated total number of pixels is equal to or larger than said third threshold or when said plurality of areas include an area in which said calculated total number of pixels is equal to or larger than said second threshold and is smaller than said third threshold and said calculated total number of pixels for another area adjacent to said area which is a target for calculation is equal to or larger than the fourth threshold, carrying out a control operation of forming a next print image by using an ink area in a new unit area, and for, when said calculated total number of pixels is smaller than said second threshold and when said calculated total number of pixels is equal to or larger than said second threshold and is smaller than said third threshold and said calculated total number of pixels for the other area adjacent to said area is smaller than the fourth threshold, carrying out a control operation of forming a next print image by using a remaining area of an already-used ink area in a unit area having said predetermined size.

2. The print control device according to claim 1, wherein said print control device includes:

a number-of-remaining-ink-screens detecting unit for detecting a number of remaining printable screens of the ink sheet;

a remaining ink screen number comparing unit for determining whether or not the number of remaining ink screens detected by said number-of-remaining-ink-screens detecting unit is equal to or larger than a predetermined threshold; and a threshold selecting unit for changing said first through fourth thresholds on a basis of results of the comparison by said remaining ink screen number comparing unit.

3. The print control device according to claim 1, wherein said print control device includes:

an environmental temperature detecting unit for detecting an operating environmental temperature of said thermal transfer printer;

an environmental temperature comparing unit for determining whether or not the temperature detected by said environmental temperature detecting unit is equal to or higher than a predetermined threshold; and a threshold selecting unit for changing said first through fourth thresholds on a basis of results of the comparison by said environmental temperature comparing unit.

4. A print control device for use in a thermal transfer printer that puts an ink sheet and a recording paper on top of each other, and, while conveying said ink sheet, produces a plurality of heat transfer prints of an image in units of a predetermined size, the plurality of heat transfer prints extending on said recording paper in a direction of said conveyance and the image having a size smaller than said predetermined size, said print control device comprising:

an image area dividing unit for dividing an image to be printed into a plurality of areas;

an ink sheet damage calculating unit for comparing image element density data of each of said areas with a first threshold set correspondingly to said each of said areas to calculate a total number of pixels each having density data equal to or larger than said first threshold for each of said areas, and for comparing the total number of pixels calculated for said each of said areas with a second threshold set correspondingly to said each of said areas and with a third threshold larger than said second threshold; and a printing operation selecting unit for, when said plurality of areas include an area in which said calculated total number of pixels is equal to or larger than said second threshold and is smaller than said third threshold, carrying out a control operation of forming a print image by using an ink area on a rear side of said conveyance direction in a unit area having said predetermined size and forming a next print image by using an ink area on a front side of said conveyance direction in the unit area having said predetermined size, when said calculated total number of pixels is smaller than said second threshold in every one of said plurality of areas, carrying out a control operation of forming a print image by using an ink area on a front side of said conveyance direction in the unit area having said predetermined size and forming a next print image by using an ink area on a rear side of said conveyance direction in the unit area having said predetermined size, and, when said calculated total number of pixels is equal to or larger than said third threshold in either one of said plurality of areas, carrying out a control operation of forming a print image by using an ink area on a front side of said conveyance direction in the unit area having said predetermined size and forming a next print image by using an ink area in a new unit area.

5. A print control device for use in a thermal transfer printer that puts an ink sheet and a recording paper on top of each other, and, while conveying said ink sheet, produces a plurality of heat transfer prints of an image in units of a predetermined size, the plurality of heat transfer prints extending on said recording paper in a direction of said conveyance and the image having a size smaller than said predetermined size, said print control device comprising:

an image area dividing unit for dividing an image to be printed into a plurality of areas;

an ink sheet damage calculating unit for comparing image element density data of each of said areas into which the image is divided with a first threshold set correspondingly to said each of said areas to calculate a total number of pixels each having density data equal to or larger than said first threshold for each of said areas, and for comparing the total number of pixels calculated for said each of said areas with a second threshold set correspondingly to said each of said areas; and a printing operation selecting unit for using a remaining area of an already-used ink area in a unit area having said predetermined size for formation of a next print image when said calculated total number of pixels is smaller than said second threshold in every one of all the areas, and for using an ink area in a new unit for formation of a next print image when said total number of pixels is equal to or larger than said second threshold.

6. A print control device for use in a thermal transfer printer that puts an ink sheet and a recording paper on top of each other, and, while conveying said ink sheet, produces a plurality of heat transfer prints of an image in units of a predetermined size, the plurality of heat transfer prints extending on said recording paper in a direction of said conveyance and the image having a size smaller than said predetermined size, said print control device comprising:

an image area dividing unit for dividing an image to be printed into a plurality of areas;

an ink sheet damage calculating unit for comparing image element density data of each of said areas into which the image is divided with a first threshold set correspondingly to said each of said areas to calculate a total number of pixels each having density data equal to or larger than said first threshold for each of said areas, and for comparing the total number of pixels calculated for said each of said areas with a second threshold set correspondingly to said each of said areas; and a printing operation selecting unit for, when said plurality of areas include an area in which said calculated total number of pixels is equal to or larger than said second threshold, carrying out a control operation of using an ink area on a rear side of said conveyance direction in a unit area having said predetermined size for formation of a target print image, and, when said calculated total number of pixels is smaller than said second threshold in every one of all the areas, carrying out a control operation of using an ink area on a front side of said conveyance direction in a unit area having said predetermined size for the formation of the target print image.

7. A print control device for use in a thermal transfer printer that puts an ink sheet and a recording paper on top of each other, and, while conveying said ink sheet, produces a plurality of heat transfer prints of an image in units of a predetermined size, the plurality of heat transfer prints extending on said recording paper in a direction of said conveyance and the image having a size smaller than said predetermined size, and that forms an overcoat layer for protecting a printed image, said print control device comprising:

an image area dividing unit for dividing an image to be printed into a plurality of areas;

an ink sheet damage calculating unit for comparing image element density data of each of said areas with a first threshold set correspondingly to said each of said areas to calculate a total number of pixels each having density data equal to or larger than said first threshold for each of said areas, and for comparing the total number of pixels calculated for said each of said areas with a second threshold set correspondingly to said each of said areas;

an OP transfer mode determining unit for determining whether a transfer mode of said overcoat layer is a gloss mode in which a transfer surface is a glossy surface, or a matt mode in which the transfer surface is a matt surface; and a printing operation selecting unit for, when said OP transfer mode determining unit determines that the transfer mode is the gloss mode and said calculated total number of pixels is smaller than said second threshold in every one of all the areas, carrying out a control operation of using a remaining area of an already-used ink area in a unit area having said predetermined size for formation of a next print image, and, when said OP transfer mode determining unit determines that the transfer mode is the matt mode or the plurality of areas include an area in which said calculated total number of pixels is equal to or larger than said second threshold, carrying out a control operation of forming a next print image by using an ink area in a new unit area.

8. A print control device for use in a thermal transfer printer that puts an ink sheet having an overcoat area and a recording paper on top of each other, and, while conveying said ink sheet, produces a plurality of heat transfer prints of an image in units of a predetermined size, the plurality of heat transfer prints extending on said recording paper in a direction of said conveyance and the image having a size smaller than said predetermined size, and that forms an overcoat layer for protecting a printed image by transferring said overcoat area to said recording paper, said print control device comprising:

an OP transfer mode determining unit for determining whether a transfer mode of said overcoat layer is a gloss mode in which a transfer surface is a glossy surface, or a matt mode in which the transfer surface is a matt surface; and a printing operation selecting unit for, when said OP transfer mode determining unit determines that the transfer mode is the gloss mode, carrying out a control operation of using an overcoat area on a front side of said conveyance direction in a unit area having said predetermined size for formation of said overcoat layer, and, when said OP transfer mode determining unit determines that the transfer mode is the matt mode, carrying out a control operation of using an overcoat area on a rear side of said conveyance direction in the unit area having said predetermined size for formation of said overcoat layer.

9. A print control device for use in a thermal transfer printer that puts an ink sheet and a recording paper on top of each other, and, while conveying said ink sheet, drives a thermal head to produce a plurality of heat transfer prints of an image in units of a predetermined size, the plurality of heat transfer prints extending on said recording paper in a direction of said conveyance and the image having a size smaller than said predetermined size, said print control device comprising:

a thermal head temperature detecting unit for detecting a temperature of said thermal head;

a detected temperature comparing unit for determining whether or not the thermal head temperature detected by said thermal head temperature detecting unit is equal to or higher than a predetermined threshold; and a printing operation selecting unit for, when said thermal head temperature is equal to or higher than the predetermined threshold, carrying out a control operation of forming a next print image by using an ink area in a new unit area having said predetermined size, and for, when said thermal head temperature is lower than said threshold, carrying out a control operation of forming a next print image by using a remaining area of an already-used ink area in a unit area having said predetermined size.

10. A print control device for use in a thermal transfer printer that puts an ink sheet and a recording paper on top of each other, and, while conveying said ink sheet, produces a plurality of heat transfer prints of an image in units of a predetermined size, the plurality of heat transfer prints extending on said recording paper in a direction of said conveyance and the image having a size smaller than said predetermined size, said print control device comprising:

an image area dividing unit for dividing an image to be printed into an area on a front side of a direction of conveyance of said ink sheet and an area on a rear side of the direction of conveyance of said ink sheet;

an ink sheet damage calculating unit for comparing image element density data about each of said areas into which the inputted image is divided with a first threshold set correspondingly to said each of said areas to calculate a total number of pixels each having density data equal to or larger than said first threshold for said each of said areas, and for comparing the total number of pixels calculated for said each of said areas with a second threshold set correspondingly to said each of said areas; and an image data converting unit for carrying out a control operation of flipping said image to be printed by 180 degrees to print this image when the total number of pixels of the area on a front side of said direction of conveyance is smaller than said second threshold set for said area and the total number of pixels of the area on a rear side of said direction of conveyance is equal to or larger than the second threshold set for said area.

* * * * *